US010694835B2

(12) United States Patent
Peterson et al.

(10) Patent No.: US 10,694,835 B2
(45) Date of Patent: Jun. 30, 2020

(54) PROTECTIVE CASE FOR USE WITH DEVICE GRIP

(71) Applicant: Otter Products, LLC, Fort Collins, CO (US)

(72) Inventors: Joshua K. Peterson, Fort Collins, CO (US); Jamie L. Johnson, Fort Collins, CO (US); Alyson J. Beck, Fort Collins, CO (US); Dustin S. Rodriguez, Fort Collins, CO (US)

(73) Assignee: Otter Products, LLC, Fort Collins, CO (US)

( * ) Notice: Subject to any disclaimer, the term of this patent is extended or adjusted under 35 U.S.C. 154(b) by 0 days.

(21) Appl. No.: 16/423,390

(22) Filed: May 28, 2019

(65) Prior Publication Data

US 2019/0281961 A1 Sep. 19, 2019

Related U.S. Application Data

(63) Continuation of application No. 16/275,969, filed on Feb. 14, 2019.

(Continued)

(51) Int. Cl.
*A45F 5/00* (2006.01)
*A45C 11/00* (2006.01)

(52) U.S. Cl.
CPC ..... *A45F 5/00* (2013.01); *A45C 11/00* (2013.01); *A45C 2011/001* (2013.01);
(Continued)

(58) Field of Classification Search
CPC ..... H04M 1/04; A45F 5/00; A45F 2200/0516; A45F 2200/0525; A45C 11/00; A45C 2011/002; A45C 2011/003; A45C 2200/15
See application file for complete search history.

(56) References Cited

U.S. PATENT DOCUMENTS 3,023,885 A 3/1962 Kindseth
3,480,310 A 11/1969 Mcelwain
(Continued)

FOREIGN PATENT DOCUMENTS

CN 202488509 U 10/2012
FR 935529 A 6/1948
(Continued)

OTHER PUBLICATIONS

Outfityours.Com (Top 5 Best Clear iPhone 5S and iPhone 5 Cases—Incase, Otterbox, Griffin, Moshi [retrieved from https://www.youtube.com/watch?v=rWYKJvsDHPw],YouTube.com [online], May 17, 2013 [retrieved Oct. 11, 2017]), 3 pages.
(Continued)

*Primary Examiner* — Justin M Larson

(57) ABSTRACT

A protective case system includes an extendable device grip and a protective case. The extendable device grip includes an attachment mechanism and has a stowed configuration and extended configuration. The protective case includes an inner shell having a receiver and an outer cushion layer. The inner shell is configured for receiving and removably retaining an electronic device. The extendable device grip is removably attachable to the receiver for removably attaching the extendable device grip to the inner shell. The outer cushion layer first over the inner shell and includes an aperture for accessing the device grip when the extendable device grip is attached to the inner shell.

20 Claims, 16 Drawing Sheets

Related U.S. Application Data

(60) Provisional application No. 62/663,316, filed on Apr. 27, 2018, provisional application No. 62/643,429, filed on Mar. 15, 2018, provisional application No. 62/782,919, filed on Dec. 20, 2018.

(52) U.S. Cl.
CPC ... *A45C 2011/002* (2013.01); *A45C 2011/003* (2013.01); *A45C 2200/15* (2013.01); *A45F 2200/0508* (2013.01); *A45F 2200/0516* (2013.01); *A45F 2200/0525* (2013.01)

(56) References Cited

U.S. PATENT DOCUMENTS 3,521,216 A 7/1970 Tolegian
3,786,391 A 1/1974 Mathauser
3,808,577 A 4/1974 Mathauser
3,810,258 A 5/1974 Mathauser
3,816,679 A 6/1974 Hotchkiss
4,029,999 A 6/1977 Neumann et al.
4,097,878 A 6/1978 Cramer
4,182,558 A 1/1980 Matsuo
4,431,333 A 2/1984 Chandler
4,584,718 A 4/1986 Fuller
4,856,658 A 8/1989 Novak
4,859,110 A 8/1989 Dommel
4,925,146 A 5/1990 Hegarty
4,933,988 A 6/1990 Thibault
4,940,414 A 7/1990 Lee
4,963,902 A 10/1990 Fukahori
4,981,243 A 1/1991 Rogowski
4,994,829 A 2/1991 Tsukamoto
5,025,921 A 6/1991 Gasparaitis et al.
5,054,733 A 10/1991 Shields
5,123,044 A 6/1992 Tate
5,138,523 A 8/1992 Benck et al.
5,359,756 A 11/1994 Miyauchi et al.
5,360,108 A 11/1994 Alagia
5,368,159 A 11/1994 Doria
5,380,968 A 1/1995 Morse
5,383,091 A 1/1995 Snell
5,386,084 A 1/1995 Risko
5,388,691 A 2/1995 White
5,388,692 A 2/1995 Withrow et al.
D365,927 S 1/1996 Cho
5,508,479 A 4/1996 Schooley
5,541,813 A 7/1996 Satoh et al.
5,604,050 A 2/1997 Brunette et al.
5,664,292 A 9/1997 Chen
5,671,120 A 9/1997 Kikinisi
5,992,807 A 11/1999 Tarulli
5,996,956 A 12/1999 Shawver
6,097,593 A 8/2000 Faranda et al.
6,115,248 A 9/2000 Canova et al.
6,135,408 A 10/2000 Richter
6,149,116 A 11/2000 Won
6,151,206 A 11/2000 Kato et al.
6,302,617 B1 10/2001 Rumpp
6,305,588 B1 10/2001 Michel et al.
6,305,656 B1 10/2001 Wemyss
6,311,017 B1 10/2001 Mori
6,317,313 B1 11/2001 Mosgrove et al.
6,349,824 B1 2/2002 Yamada
6,375,009 B1 4/2002 Lee
6,409,531 B1 6/2002 Millard
6,445,577 B1 9/2002 Madsen et al.
6,456,487 B1 9/2002 Hetterick
6,464,524 B1 10/2002 Kerr et al.
6,490,155 B2 12/2002 Han et al.
6,514,624 B2 2/2003 Takemoto
6,545,862 B1 4/2003 Gettemy et al.
6,616,111 B1 9/2003 White
6,625,394 B2 9/2003 Smith et al.
6,626,362 B1 9/2003 Steiner et al.
6,646,864 B2 11/2003 Richardson
6,685,493 B2 2/2004 Birkenmaier et al.
6,701,159 B1 3/2004 Powell
6,705,580 B1 3/2004 Bain
6,762,935 B2 7/2004 Hidewasa
6,865,076 B2 3/2005 Lunsford
6,888,940 B1 5/2005 Deppen
6,966,519 B2 11/2005 Salentine et al.
7,050,841 B1 5/2006 Onda
7,072,699 B2 7/2006 Eiden
D526,780 S 8/2006 Richardson et al.
7,145,767 B2 12/2006 Mache et al.
7,158,376 B2 1/2007 Richardson et al.
7,180,735 B2 2/2007 Thomas et al.
7,194,291 B2 3/2007 Peng
D542,524 S 5/2007 Richardson et al.
7,230,823 B2 6/2007 Richardson et al.
7,236,588 B2 6/2007 Gartrell
7,287,738 B2 10/2007 Pitlor
7,311,526 B2 12/2007 Rohrbach et al.
7,343,184 B2 3/2008 Rostami
7,359,184 B2 4/2008 Lord
7,374,142 B2 5/2008 Carnevali
D574,819 S 8/2008 Andre et al.
7,431,251 B2 10/2008 Carnevali
D581,155 S 11/2008 Richardson et al.
D581,421 S 11/2008 Richardson et al.
D587,008 S 2/2009 Richardson et al.
D589,016 S 3/2009 Richardson et al.
7,555,325 B2 6/2009 Goros
7,558,594 B2 7/2009 Wilson
7,575,389 B2 8/2009 Nance
7,661,567 B2 * 2/2010 Myers ..... A45C 13/20 224/217
7,688,580 B2 3/2010 Richardson et al.
7,845,608 B1 12/2010 Chen et al.
7,871,218 B2 1/2011 Frey et al.
7,889,489 B2 2/2011 Richardson et al.
7,907,394 B2 3/2011 Richardson et al.
7,933,122 B2 4/2011 Richardson et al.
8,016,107 B2 9/2011 Emsky
8,049,727 B2 11/2011 Hanson et al.
8,204,561 B2 6/2012 Mongan et al.
8,303,336 B2 11/2012 Smith
8,442,604 B1 5/2013 Diebel
8,453,344 B2 6/2013 Nishiwaki et al.
8,453,835 B2 6/2013 So
8,457,701 B2 6/2013 Diebel
8,490,783 B1 7/2013 Fan
8,509,865 B1 8/2013 LaColla et al.
8,514,568 B2 8/2013 Qiao et al.
8,560,031 B2 * 10/2013 Barnett ..... F16M 11/40 455/575.8
8,567,599 B2 10/2013 Beatty et al.
8,599,547 B2 12/2013 Richardson et al.
8,608,502 B2 12/2013 Witter et al.
8,646,739 B2 2/2014 Moyer
8,676,281 B1 3/2014 Caulder et al.
8,706,175 B2 4/2014 Cho
8,737,066 B1 * 5/2014 Block ..... A45F 5/00 224/217
8,755,852 B2 6/2014 Hynecek et al.
8,770,402 B2 7/2014 Bergreen et al.
8,777,002 B2 7/2014 Thomas et al.
8,798,675 B2 8/2014 Salmon et al.
8,800,762 B2 8/2014 Fathollahi
8,830,663 B2 9/2014 Child et al.
8,844,098 B2 * 9/2014 Karmatz ..... B25G 1/102 16/422
8,875,879 B2 11/2014 Diebel et al.
D722,603 S 2/2015 Lay et al.
8,955,678 B2 2/2015 Murphy et al.
8,965,458 B2 2/2015 Richardson et al.
D725,119 S 3/2015 Gaylord
D726,732 S 4/2015 Lay et al.
9,008,738 B1 4/2015 Dong
9,060,580 B2 6/2015 Tages
9,089,056 B2 7/2015 Rayner
9,098,238 B2 8/2015 Richardson et al.

(56) References Cited

U.S. PATENT DOCUMENTS

D739,857 S 9/2015 Lay et al.
9,125,297 B2 9/2015 Magness
9,136,897 B2 9/2015 Hynecek et al.
9,153,112 B1 10/2015 Kiani et al.
9,226,057 B1 12/2015 Davis et al.
9,266,664 B2 2/2016 Bau
9,274,556 B2 3/2016 Gallouzi et al.
9,295,174 B2 3/2016 Witter et al.
9,301,584 B2 * 4/2016 Butts ..... A45C 11/00
9,316,026 B2 4/2016 Myers et al.
9,316,344 B2 * 4/2016 Le Gette ..... F16M 11/041
9,367,090 B2 6/2016 Barnett et al.
9,377,154 B2 6/2016 Hung et al.
D762,258 S 7/2016 Jenkins
9,397,719 B1 7/2016 Schmidt
9,408,448 B2 8/2016 Kay et al.
D766,226 S 9/2016 Wu
D766,227 S 9/2016 Wu
D769,855 S 10/2016 Deng
9,462,099 B2 10/2016 Wilson et al.
9,470,358 B2 * 10/2016 Le Gette ..... F16M 11/10
9,481,490 B2 11/2016 Venida et al.
9,487,376 B2 11/2016 Salentine et al.
9,503,147 B2 11/2016 Witter et al.
D775,115 S 12/2016 Ormsbee et al.
9,537,526 B2 1/2017 Wilson et al.
9,538,675 B2 * 1/2017 Le Gette ..... F16M 11/04
9,545,140 B1 1/2017 Johnson et al.
9,615,476 B2 4/2017 Rayner et al.
9,622,556 B2 4/2017 Fathollahi et al.
9,654,605 B2 5/2017 Goldfain et al.
9,660,684 B2 5/2017 Rayner
9,743,540 B2 8/2017 Magness
9,765,921 B2 9/2017 Vogel et al.
9,774,713 B2 9/2017 Guerdrum et al.
D799,469 S 10/2017 Esses
9,788,620 B1 10/2017 Parkinson
9,800,283 B2 10/2017 Schmidt
9,807,211 B2 10/2017 Guerdrum et al.
9,851,758 B2 12/2017 Rowley
D808,376 S 1/2018 Kim
D808,377 S 1/2018 Witter et al.
9,871,550 B2 1/2018 Witter et al.
9,913,388 B1 3/2018 Mchatet
9,930,943 B2 * 4/2018 Lach ..... A45C 11/00
D824,376 S 7/2018 Lee
10,019,034 B2 * 7/2018 Barnett ..... G06F 1/1632
10,027,783 B2 7/2018 Dukerschein et al.
10,030,807 B1 * 7/2018 Hobbs ..... H04M 1/00
10,054,259 B2 * 8/2018 Hobbs ..... F16M 11/40
10,058,155 B2 8/2018 Guerdrum et al.
10,060,573 B2 * 8/2018 Hobbs ..... H04M 1/00
D827,627 S 9/2018 Lee
D829,700 S 10/2018 Kim
10,103,769 B2 10/2018 Witter et al.
10,136,716 B2 11/2018 Northrup et al.
D835,091 S * 12/2018 Torrance ..... D14/253
10,178,903 B2 1/2019 Guerdrum et al.
10,200,518 B2 * 2/2019 Richter ..... A45F 5/00
10,206,472 B1 2/2019 Northrup et al.
10,244,854 B1 * 4/2019 Haber ..... A45F 5/10
10,278,299 B2 * 4/2019 Kim ..... E05D 3/022
D847,805 S * 5/2019 Lederer ..... D14/250
10,348,352 B2 * 7/2019 Barnett ..... F16M 11/38
10,386,009 B2 * 8/2019 Hobbs ..... F16M 11/06
10,389,860 B2 * 8/2019 Nahum ..... A45F 5/10
10,413,027 B1 * 9/2019 Olson ..... F16M 11/32
D864,581 S * 10/2019 Bersh ..... D4/116
10,463,116 B2 * 11/2019 Barnett ..... A44B 99/005
D870,736 S * 12/2019 Lederer ..... D14/447
10,530,411 B2 * 1/2020 Gehlhausen ..... A45C 11/182
2001/0000617 A1 5/2001 Tracy
2001/0054594 A1 12/2001 Maier-Hunke
2002/0065054 A1 5/2002 Humphreys et al.
2002/0079244 A1 6/2002 Kwong
2003/0141329 A1 7/2003 Huang
2004/0029405 A1 2/2004 Neidlein
2004/0150945 A1 8/2004 Mache et al.
2005/0088811 A1 4/2005 Ulla et al.
2005/0213298 A1 9/2005 Doherty et al.
2005/0224508 A1 10/2005 Tajiri et al.
2005/0279661 A1 12/2005 Hodges
2005/0284904 A1 12/2005 Knapp et al.
2006/0027718 A1 2/2006 Quijano et al.
2006/0066438 A1 3/2006 Altounian et al.
2006/0086873 A1 4/2006 Chen
2006/0172765 A1 8/2006 Lev
2006/0237495 A1 10/2006 Chen et al.
2006/0243679 A1 11/2006 Dickerson
2006/0255493 A1 11/2006 Fouladpour
2007/0071423 A1 3/2007 Fantone et al.
2007/0115387 A1 5/2007 Ho
2007/0146985 A1 6/2007 Mick et al.
2007/0155448 A1 7/2007 Hong
2007/0158220 A1 7/2007 Cleereman et al.
2007/0181620 A1 * 8/2007 Carver, III ..... A44C 9/0053 224/217
2007/0215659 A1 9/2007 Knapp et al.
2007/0215769 A1 9/2007 Nebeker et al.
2007/0297149 A1 12/2007 Richardson et al.
2008/0083797 A1 * 4/2008 Myers ..... A45C 13/20 224/217
2008/0117578 A1 5/2008 Moscovitch
2008/0163463 A1 7/2008 Hulden
2008/0199252 A1 8/2008 Frey et al.
2008/0304692 A1 12/2008 Zhang
2009/0001232 A1 1/2009 Seo et al.
2009/0034169 A1 2/2009 Richardson et al.
2009/0079665 A1 3/2009 Moscovitch
2009/0084705 A1 4/2009 Justiss
2009/0161903 A1 6/2009 White
2009/0237377 A1 9/2009 Lai et al.
2009/0283184 A1 11/2009 Plan
2010/0006468 A1 1/2010 Lin
2010/0078343 A1 4/2010 Hoellwarth et al.
2010/0090085 A1 4/2010 Corrion
2010/0093412 A1 4/2010 Serra et al.
2010/0122756 A1 5/2010 Longinotti-Buitoni
2010/0141864 A1 6/2010 Lai
2010/0147737 A1 6/2010 Richardson et al.
2010/0181450 A1 7/2010 Hulick et al.
2010/0195279 A1 8/2010 Michael
2010/0203931 A1 8/2010 Hynecek et al.
2010/0215188 A1 8/2010 Wilcox
2010/0230301 A1 9/2010 Fellig
2011/0031287 A1 2/2011 Gette et al.
2011/0064401 A1 3/2011 DeSorbo
2011/0073505 A1 3/2011 Stiehl
2011/0073608 A1 3/2011 Richardson et al.
2011/0075349 A1 3/2011 Ma et al.
2011/0101058 A1 5/2011 Heckman
2011/0170256 A1 7/2011 Lee
2011/0192857 A1 8/2011 Rothbaum et al.
2011/0216495 A1 9/2011 Marx
2011/0228459 A1 9/2011 Richardson et al.
2011/0235846 A1 9/2011 Jiang et al.
2011/0294556 A1 12/2011 Carlberg et al.
2011/0297566 A1 12/2011 Gallagher et al.
2011/0314651 A1 12/2011 Behar et al.
2012/0018325 A1 1/2012 Kim
2012/0031788 A1 2/2012 Mongan et al.
2012/0037524 A1 2/2012 Thomas et al.
2012/0037536 A1 2/2012 Thomas et al.
2012/0043235 A1 2/2012 Klement
2012/0074005 A1 3/2012 Johnson et al.
2012/0092377 A1 4/2012 Stein
2012/0106069 A1 5/2012 Strauser
2012/0111881 A1 5/2012 Gaddis et al.
2012/0118770 A1 * 5/2012 Valls ..... F16M 13/04 206/320
2012/0170194 A1 7/2012 Lord et al.
2012/0175474 A1 7/2012 Barnard et al.
2012/0187260 A1 7/2012 Moyer
2012/0252543 A1 10/2012 Cho

(56) References Cited

U.S. PATENT DOCUMENTS

2012/0267491 A1 10/2012 Chiu
2012/0287565 A1 11/2012 Bennett
2012/0325702 A1 12/2012 Gallagher et al.
2012/0326003 A1 12/2012 Solow et al.
2013/0027862 A1 1/2013 Rayner
2013/0039521 A1 2/2013 Zhou et al.
2013/0068915 A1 3/2013 Yang
2013/0083953 A1 4/2013 Chang
2013/0088813 A1 4/2013 Su et al.
2013/0098788 A1 4/2013 McCarville et al.
2013/0107449 A1 5/2013 Su et al.
2013/0109253 A1 5/2013 Gammon et al.
2013/0117487 A1 5/2013 Leung
2013/0126533 A1 5/2013 Klosky
2013/0175186 A1 7/2013 Simmer
2013/0177181 A1 7/2013 Marcus
2013/0181584 A1 7/2013 Whitten et al.
2013/0220841 A1 8/2013 Yang
2013/0220847 A1 8/2013 Fisher et al.
2013/0222989 A1 8/2013 Chen
2013/0230202 A1 9/2013 Widner et al.
2013/0240578 A1 9/2013 Yu
2013/0262248 A1 10/2013 Kim et al.
2013/0292269 A1 11/2013 Tages
2013/0292288 A1 11/2013 Willes
2013/0303000 A1 11/2013 Witter et al.
2013/0318775 A1 12/2013 Peters
2014/0003647 A1 1/2014 Liu
2014/0049142 A1 2/2014 Magness
2014/0065847 A1 3/2014 Salmon et al.
2014/0080553 A1 3/2014 Torset et al.
2014/0097102 A1 4/2014 Piatt et al.
2014/0099526 A1 4/2014 Powell et al.
2014/0128132 A1 5/2014 Cox
2014/0141838 A1 5/2014 Cai et al.
2014/0152890 A1 6/2014 Rayner
2014/0166707 A1 6/2014 Leisey-Bartsch
2014/0168884 A1 6/2014 Wylie
2014/0183064 A1 7/2014 Ge
2014/0183065 A1 7/2014 Toulotte
2014/0187289 A1 7/2014 Cataldo et al.
2014/0200056 A1 7/2014 Liu
2014/0227026 A1 8/2014 O'Neill et al.
2014/0228074 A1 8/2014 Kulkarni et al.
2014/0262848 A1 9/2014 Fathollahi et al.
2014/0262934 A1 9/2014 Fathollahi et al.
2014/0265765 A1 9/2014 Khodapanah et al.
2014/0265767 A1 9/2014 Fathollahi
2014/0299488 A1 10/2014 Andrew
2014/0302896 A1 10/2014 Xu et al.
2014/0325818 A1 11/2014 Mayfield
2014/0355200 A1 12/2014 Thiers
2015/0061477 A1 3/2015 Wilson
2015/0062787 A1 3/2015 Wilson et al.
2015/0068935 A1 3/2015 Kay et al.
2015/0083615 A1 3/2015 Lay et al.
2015/0111623 A1 4/2015 Hegemier et al.
2015/0133183 A1 5/2015 Alameh et al.
2015/0141090 A1 5/2015 Hwan et al.
2015/0141095 A1 5/2015 Kim
2015/0153791 A1 6/2015 Wong
2015/0172431 A1 6/2015 Huang
2015/0189160 A1 7/2015 Auger et al.
2015/0194997 A1 7/2015 Johnson et al.
2015/0194998 A1 7/2015 Fathollahi
2015/0195938 A1 7/2015 Witter et al.
2015/0201723 A1 7/2015 Rayner et al.
2015/0214989 A1 7/2015 Yeh et al.
2015/0220766 A1 8/2015 Russell et al.
2015/0257285 A1 9/2015 Wilson et al.
2015/0257287 A1 9/2015 Tages
2015/0304466 A1 10/2015 Tamatsu
2015/0335138 A1* 11/2015 Juarbe ..... A45F 5/00 224/218
2016/0007705 A1 1/2016 Liebers et al.
2016/0036478 A1 2/2016 Wong
2016/0040825 A1 2/2016 Franklin
2016/0045005 A1* 2/2016 Richardson ..... H05K 5/0017 224/191
2016/0072933 A1 3/2016 Cox
2016/0080024 A1 3/2016 Wilson et al.
2016/0122821 A1 5/2016 Liu et al.
2016/0142093 A1 5/2016 Phang
2016/0150861 A1 6/2016 Yao et al.
2016/0164565 A1 6/2016 Witter et al.
2016/0179143 A1 6/2016 Bidwell et al.
2016/0183392 A1 6/2016 Kelley
2016/0195898 A1 7/2016 Lau
2016/0198822 A1 7/2016 Lee et al.
2016/0254836 A1 9/2016 Alsberg et al.
2016/0261133 A1 9/2016 Wang
2016/0282905 A1 9/2016 Laine et al.
2016/0286920 A1 10/2016 Lean et al.
2016/0286921 A1 10/2016 Northrup et al.
2016/0295981 A1 10/2016 Lay et al.
2016/0347257 A1 12/2016 Buchanan
2017/0026498 A1 1/2017 Goldfain et al.
2017/0041037 A1 2/2017 Witter et al.
2017/0099922 A1 4/2017 Guerdrum et al.
2017/0099924 A1 4/2017 Fathollahi et al.
2017/0119120 A1 5/2017 Richardson et al.
2017/0195000 A1* 7/2017 Srour ..... H04B 1/3888
2017/0237460 A1 8/2017 Rayner
2017/0279478 A1 9/2017 Fathollahi
2017/0327054 A1 11/2017 Yu et al.
2017/0328517 A1 11/2017 Wessels
2017/0353208 A1 12/2017 Wilson et al.
2017/0359096 A1 12/2017 Witter et al.
2017/0360200 A1 12/2017 Cohen
2018/0013463 A1* 1/2018 Jeon ..... H04B 1/3888
2018/0101197 A1* 4/2018 Barnett ..... G06F 1/1632
2018/0136695 A1 5/2018 Lo et al.
2018/0167498 A1 6/2018 Drakos
2018/0369599 A1 12/2018 Smith
2019/0094853 A1 3/2019 Overall
2019/0141848 A1 5/2019 Sung
2019/0208046 A1* 7/2019 Gluck ..... H04M 1/04
2019/0211966 A1* 7/2019 Nahum ..... F16M 13/06
2019/0212774 A1 7/2019 Patterson et al.
2019/0215387 A1* 7/2019 Chiang ..... G06F 1/1656
2019/0222682 A1 7/2019 Ren et al.
2019/0225378 A1* 7/2019 Barnett ..... A45F 3/16
2019/0229763 A1 7/2019 Nebel et al.
2019/0243421 A1* 8/2019 Barnett ..... G06F 1/1656
2019/0245960 A1* 8/2019 Nahum ..... H04M 1/04
2019/0250664 A1 8/2019 Eslava et al.
2019/0278327 A1* 9/2019 Barnett ..... H04B 1/3877
2019/0278328 A1* 9/2019 Barnett ..... G06F 1/1632
2019/0281147 A1 9/2019 Sherburne et al.
2019/0281960 A1* 9/2019 Peterson ..... A45F 5/00
2019/0281961 A1* 9/2019 Peterson ..... A45C 11/00
2019/0286191 A1 9/2019 Correll, Jr.
2019/0335030 A1* 10/2019 Nahum ..... A45F 5/10
2019/0335031 A1* 10/2019 Nahum ..... F16M 11/046

FOREIGN PATENT DOCUMENTS

KR 200446444 10/2009
KR 101394285 5/2014
WO 1994000037 A1 1/1994
WO 1999041958 A1 8/1999
WO 2015103599 A1 7/2015

OTHER PUBLICATIONS

Randomrazr (New Otterbox Symmetry Case—The Slim Protective Case for the iPhone 5S/5C [retrieved from https://www.youtube.com/watch?v=zGWZTGamuT0],YouTube.com [online], Mar. 30, 2014 [retrieved Oct. 11, 2017]), 5 pages.
Otterbox, "OtterBox and PopSockets Announce Swappable, Unstoppable Otter+Pop," dated Jan. 7, 2019, downloaded from http://

(56) References Cited

OTHER PUBLICATIONS media.otterbox.com/2019-01-07-OtterBox-and-PopSockets-Announce-Swappable-Unstoppable-Otter-Pop Jul. 3, 2019.
Otterbox, "Swappable, Unstoppable: OtterBox and PopSockets Cases Available Now," dated Mar. 26, 2019, downloaded from http://media.otterbox.com/2019-03-26-Swappable-Unstoppable-OtterBox-and-PopSockets-Cases-Available-Now Jul. 3, 2019.

* cited by examiner

PROTECTIVE CASE FOR USE WITH DEVICE GRIP

CROSS REFERENCE TO RELATED APPLICATIONS

The present application is a continuation of U.S. patent application Ser. No. 16/275,969, filed Feb. 14, 2019, U.S. Provisional Patent Application No. 62/782,919, filed Dec. 20, 2018, U.S. Provisional Patent Application No. 62/663,316, filed Apr. 27, 2018, and U.S. Provisional Patent Application No. 62/643,429, filed Mar. 15, 2018, each of which is incorporated by reference in its entirety.

BACKGROUND

Electronic devices, particularly portable electronic devices, are used for a growing variety of purposes, as well as in a growing variety of situations. Examples of portable electronic devices include smartphones, tablet computers, gaming devices, audio players, video players, cameras, portable computers, two-way radios, GPS receivers, and/or other portable devices. Portable electronic devices are susceptible to damage from a variety or forces or elements such as dropping, impact, and scratching. At the same time the cost of portable electronic devices is increasing. Improved apparatuses and techniques for protecting and holding portable and personal electronic devices are needed for better accommodating these changing use models.

SUMMARY

In one exemplary embodiment, a protective case system for use with an electronic device includes an extendable device grip and a protective case. The extendable device grip includes an attachment mechanism and has a stowed configuration and extended configuration. The extendable device grip is configured to be transitioned between the stowed configuration and the extended configuration by a user. The protective case includes a shell and a receiver. The shell is configured for receiving and removably retaining the electronic device. The shell has at least a back wall and side walls. The back and side walls of the shell are configured to cover at least a portion of the electronic device when the electronic device is installed in the shell. The outer surface of the back wall of the shell includes a recessed or concave area. The extendable device grip is removably attachable to the receiver of the shell for removably attaching the extendable device grip to the protective case. The receiver is positioned in the recessed or concave area of the outer surface of the back wall of the shell such that at least a portion of the extendable device grip is within the recessed area when the extendable device grip is attached to the protective case and is in the stowed configuration.

In some embodiments, the protective case system may also include an outer cushion layer that extends over at least a portion of the shell and includes an aperture through which the extendable device grip is attached to the shell. In some embodiments, only one of the protective case and extendable device grip may be included.

In another embodiment, a protective case is configured for use with an electronic device and with a device grip. The protective case includes a body configured for receiving and removably retaining the electronic device. The body has at least a back wall and side walls which are configured to cover at least a portion of the electronic device when the electronic device is installed in the body. The protective case also includes a grip aperture extending through the back wall of the body. The grip aperture has a size and/or a shape adapted to permit direct attachment of the device grip to a back surface of the installed electronic device through the grip aperture. A thickness of the back wall proximate the grip aperture is greater than thicknesses of other portions of the back wall such that an outer surface of the back wall is approximately flush with an end of the device grip when the device grip is attached to the installed electronic device and is in a non-extended position.

In another embodiment, a protective case is configured for use with an electronic device and a device grip. The protective case includes a body configured for receiving and removably retaining the electronic device. The body has at least a back and side walls configured to cover at least a portion of the electronic device when the electronic device is installed in the body. The protective case also includes a grip aperture extending through the back wall of the body. The grip aperture has a size and a shape adapted to permit direct attachment of the device grip to a back surface of the installed electronic device through the grip aperture. An outer surface of the back wall of the body is non-planar such that the outer surface of the back wall is approximately flush with an end of the device grip when the device grip is attached to the installed electronic device and is in a non-extended position.

In yet another embodiment, a protective case or cover is adapted for use with an electronic device and a device grip. The device grip has a proximal end and a distal end. The protective case or cover includes a body adapted for receiving and removably retaining the electronic device. The body has at least a back wall and side wall. The back and side walls are adapted to cover at least a portion of the electronic device when the electronic device is installed in the body. A grip aperture extends through the back wall of the body, the grip aperture is adapted to permit direct attachment of the proximal end of the device grip to a back surface of the installed electronic device through the grip aperture. An outer surface of the back wall of the body has a non-planar shape or contour and is adapted such that an outer edge of the grip aperture is proximate the distal end of the device grip when the device grip is attached to the installed electronic device and is in a storage position.

In a further embodiment, a protective case system for use with an electronic device includes a device grip and a protective case. The device grip is configured to be attachable to a back of the electronic device. The device grip is extendable and configured for facilitating holding of the electronic device when attached to the electronic device. The protective case includes a body and a grip aperture. The body is configured for receiving and removably retaining the electronic device. The body has at least a back and side walls. The back and side walls are configured to cover at least a portion of the electronic device when the electronic device is installed in the body. The grip aperture extends through the back wall of the body. The grip aperture has a size and a shape adapted to permit direct attachment of the device grip to a back surface of the installed electronic device through the grip aperture. The outer surface of the back wall of the body is non-planar such that the outer surface of the back wall is approximately flush with an end of the device grip when the device grip is attached to the installed electronic device and is in a non-extended position.

In yet another embodiment, a protective case is configured for use with an electronic device and an extendable device grip having a stowed position and a use position. The protective case includes a shell configured for receiving and removably retaining the electronic device. The shell has at least a back wall and side walls. The back and side walls are configured to cover at least a portion of the electronic device when the electronic device is installed in the shell. An outer surface of the back wall of the shell has a concave or recessed area. The protective case also includes a receiver to which the extendable device grip is removably attachable. The receiver is positioned in the concave or recessed area of the outer surface of the back wall of the shell such that at least a portion of the extendable device grip is within the concave or recessed area when the extendable device grip is attached to the receiver and is in the stowed position.

An outer cushion layer may be included with any of the embodiments discussed herein. Other embodiments, including various combinations of the features disclosed herein, are also envisioned. Many combinations of the features are possible, including combinations that do not include all of the described features and/or include other features.

DETAILED DESCRIPTION

Electronic devices are increasingly used with protective cases and/or covers that protect the electronic devices from a variety or forces or elements such as dropping, impact, and scratching. As people carry electronic devices with them more frequently, they have become more interested in using them for a wider variety of tasks and in a wider variety of situations. Electronic devices, particularly portable electronic devices, are being used now more than ever and the longer devices are held by the user the greater the chance that they are dropped or otherwise damaged. In addition, people are using their electronic devices in a greater variety of situations. This may also increase the chance that an electronic device is dropped or otherwise damaged. In some cases, these challenges are coupled with an increasing need for holders or stands that hold the device in a particular preferred configuration or location when the user wants the device to be visible and/or in a particular orientation but may not necessarily be holding it.

While most of the electronic device cases and/or covers discussed herein are described as "protective" cases, the apparatuses and techniques disclosed herein do not necessarily require that the case is protective and could apply to any type of electronic device case, cover, sleeve, sheath, attachment panel, etc. In other examples, the case may be water-resistant or water proof for protecting the electronic device from water or other liquids. In yet other examples, the case may have other characteristics, such as but not limited to, chemical resistance or antimicrobial characteristics.

Figure 1:
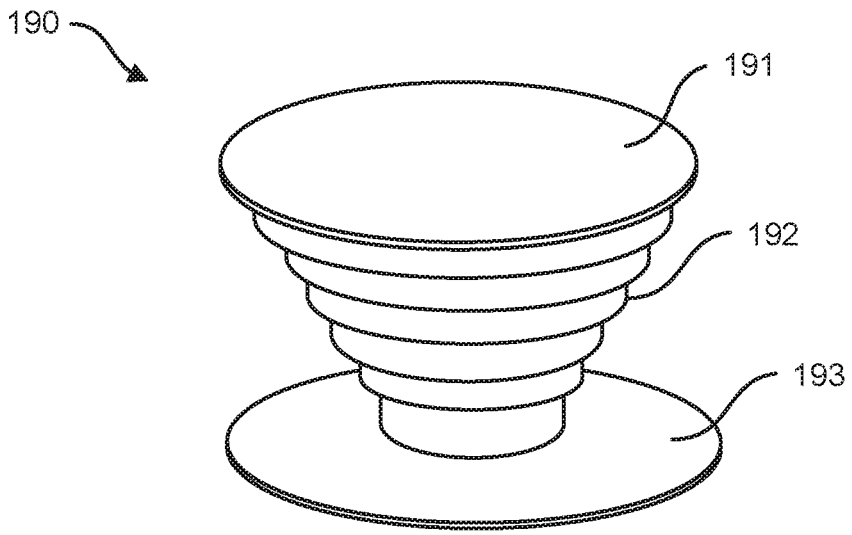
FIG. 1 illustrates a device grip.

FIG. 1 illustrates a device grip 190 which may be used with electronic devices and protective cases or covers as described herein. Device grip 190 is one example of a device grip, or holder, which is currently available in the market. The particular device grip illustrated in FIG. 1 is a PopSocket® sold by PopSockets of Boulder, Colo. Device grip 190 is used in the examples herein only for explanation purposes. The improvements discussed herein are not limited to the particular device grip 190 illustrated in FIG. 1 and may be applicable to many different types of device grips, holders, and/or stands. Accommodating different grips, holders, and/or stands may include changing shapes, sizes, dimensions, geometries, quantities, and/or positions of case features described herein to accommodate other grips, holders, or stands. In some cases, device grip 190 may also be called a grip device, a ring holder, a finger loop, or a holder.

Device grip 190 includes a grip end 191, an expanding portion 192, and a foot 193. Foot 193 is attached to an object, permanently or removably, to allow device grip 190 to assist in the holding the object and/or make it less likely the object is dropped. Expanding portion 192 has an accordion or tapered accordion structure to allow it to be expanded or adjusted into various positions. For example, device grip 190 may have an extended or use position in which expanding portion 192 is partially or fully extended. Device grip 190 may also have a non-extended, stowed, or compressed position in which a height of device grip 190 is reduced or minimized in order to reduce its interference with other objects or activities when it is not in use.

The tapered accordion shape of expanding portion 192 may allow it to nest within itself to some extent when in the non-extended position. Device grip 190 may also have other positions as will be discussed with respect to other figures. The techniques and improvements herein may be practiced with a wide variety of other device grips and/or other device grip designs. Device grip 190 of FIG. 1 is used herein only for purposes of explanation and the improvements disclosed herein are not to be limited to any specific design or type of grip or holder.

Figure 2:
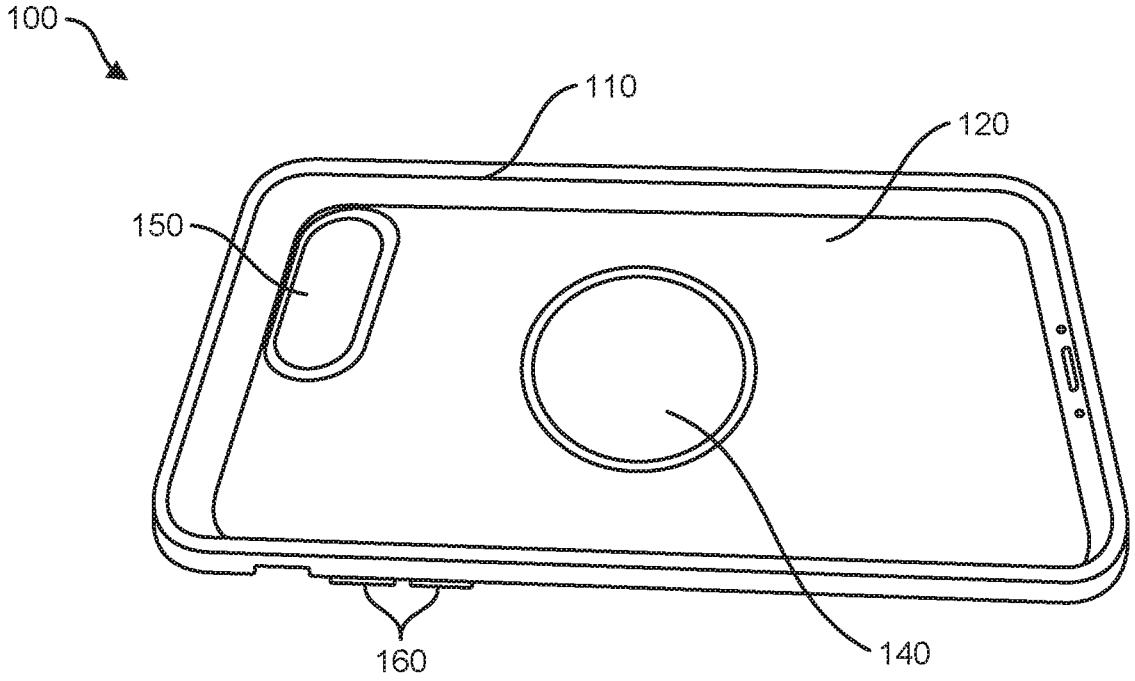
FIG. 2 illustrates a front view of a protective case.

FIG. 2 illustrates a front view of protective case 100 for an electronic device. Protective case 100 includes a body 110 and an inner surface 120. Inner surface 120 provides the primary surface(s) for receiving and holding the electronic device in the protective case. Inner surface 120 may contact the electronic device on any one or more of a back surface, on one or more side surfaces, and/or on a portion of a front surface of the electronic device. In some situations, inner surface 120 may also be referred to as or may include a cushion layer, cushioning member, or cushion liner. Inner surface 120 can be made of any suitable material such as an elastomer. The elastomer may be, but is not limited to, a thermoplastic elastomer or silicone rubber. Inner surface 120 may comprise a material that is softer than a material of body 110 for purposes of cushioning, protecting, and/or retaining the electronic device.

Inner surface 120 may be configured to cushion an installed electronic device from external forces, impacts, sudden acceleration, sudden deceleration, and other forces experienced at outer surfaces of protective case 100. Further, the compliant nature of inner surface 120 may allow it to flexibly hold the electronic device to reduce movement, shifting, or rattling of the electronic device within protective case 100. Inner surface 120 may contain cavities, coring, reliefs, ribs, channels, recesses, a grid pattern, protrusions, and/or other similar features for holding the electronic device in place, for protecting the electronic device, and/or for potentially reducing the surface area of contact between inner surface 120 and the installed electronic device.

In some embodiments, inner surface 120 may not cover the entire internal surface of the protective case. In one specific example, inner surface 120 may extend around an internal perimeter of the protective case and may not span the entire back of the protective case or the installed electronic device.

Protective case 100 also includes a front opening which permits or allows access to at least some portion of the installed electronic device. In one example, the front opening permits access to an interactive interface of the electronic device such as a touchscreen, a touch screen interface, a resistive touchscreen, a display, and/or a capacitive touchscreen. The front opening may contain a lip or edge that removably retains the electronic device in the protective case such that it does not easily or readily come out of the protective case, but can still be intentionally removed by a user when desired. The front opening may also include a lip, ledge, protrusion, raised edge, rim, elevated rim, elevated protective rim, or other raised feature around at least a portion of the front opening to reduce the chances of a front surface of the installed electronic device from coming into contact with another object or surface, particularly when protective case 100 is laid face down on a flat surface, such as a table.

Body 110 of protective case 100 may also be referred to as a structural layer, a frame, a rigid layer, a bottom shell, a shell member, an outer shell, and/or a shell of protective case 100. Body 110 extends around some or all of the outer surface of inner surface 120. Body 110 will typically be manufactured from a material that is harder, more rigid, stiffer, more puncture resistant, more crush resistant, more chemical resistant, and/or more abrasion resistant than the material of inner surface 120. The material of body 110 can be any suitable material such as a thermoplastic polymer or a synthetic polymer. The material can include polycarbonate, nylon, or glass filled nylon. Alternately, any other material, or combination of materials, that provide rigidity to protective enclosure 100 can be used. Body 110 can be formed using any suitable process, such as an injection molding process. The back or sides of body 110 may also include stylistic patterns, images, graphics, and/or one or more color combinations.

Protective case 100 also includes camera aperture 150 in a back surface of protective case 100. Camera aperture 150 provides optical access and/or an optical path to/from a camera and/or a flash of an installed electronic device. In other words, camera aperture 150 permits use of the camera and/or flash even though the electronic device is installed in protective case 100 and much of the back of the electronic device is covered by protective case 100. Camera aperture 150 may be covered with a clear, mostly clear, transparent, or mostly transparent membrane, lens, or film that protects the camera and/or the flash but also still permits optical access and/or an optical path to/from the camera and/or flash. In some examples, the membrane or film may serve a lensing function and/or provide an optical effect, such as magnification.

Protective case 100 provides protection for an installed electronic device against external forces by reducing or eliminating transfer of those forces to the installed electronic device, as well as providing a relatively soft contact surface for the installed electronic device. The relatively soft contact surface can resist scratching, scraping, marring, and/or rub marks. While providing protection, protective case 100 enables a user to still use the electronic device while it is in protective case 100.

In one embodiment, one of inner surface 120 and body 110 may be comolded (or co-molded) onto the other, comolded with the other, or overmolded onto the other. In another embodiment, they may be molded as separate pieces and adhered together after the molding process. In yet other embodiments, inner surface 120 and body 110 may not be formed, molded, or adhered together but may fit together as an assembly. Inner surface 120 and body 110 may have approximately the same thickness throughout protective enclosure 100 and in other embodiments can vary in thickness. The thickness can vary depending on the manufacturing process and/or the design of protective enclosure 100. In yet other embodiments, inner surface may not be formed from a different material than body 110 and inner surface 120 may simply be the inner surface of the member that makes up body 110.

When inner surface 120 and body 110 are formed, adhered, or fitted together, protective enclosure 100 may provide a one-piece construction that functions like, and provides benefits similar to, a more costly and possibly more complicated two-piece or three-piece assembly. However, it should be understood that the protective case features described herein are not to be limited to a protective case with an inner liner and an outer shell. It should be understood that the improvements disclosed herein may be implemented in a case with a single layer (e.g., a hard rigid layer or a soft flexible layer), a case made of a single material (e.g., a polycarbonate, a silicone, etc.), a case made of a single component, a case with more than two layers, a case made of more than two materials, and/or a case made of more than two components. For example, the case improvements disclosed herein could be implemented into a clam shell case with two or more pieces, a sliding case with two or more pieces, a hinged case with two or more pieces, etc. In other examples, protective case 100 may be a case that is assembled from a greater number of components or members. For example, protective case 100 may be assembled from two members, three members, four members, or more. The improvements disclosed herein are not intended to be limited to any particular case or protective case design.

Protective case 100 also includes one or more button pads 160 on one or more sides of protective case 100. In some cases, button pads 160 may be formed in or from the material that makes up inner surface 120. Button pads 160 correspond to respective buttons or control features of an installed electronic device. Button pads 160 enable actuation or operation of the respective buttons or control features of the installed electronic device from outside of protective case 100 without necessarily having direct access to the buttons or control features. Body 110 and/or inner surface 120 may also include an another aperture, hole, or opening for directly accessing a button, switch, port, or control feature of the installed electronic device. Button pads and apertures may have many other shapes or configurations. A protective case may have more or fewer button pads or apertures than illustrated, or no button pads or apertures at all.

Figure 3:
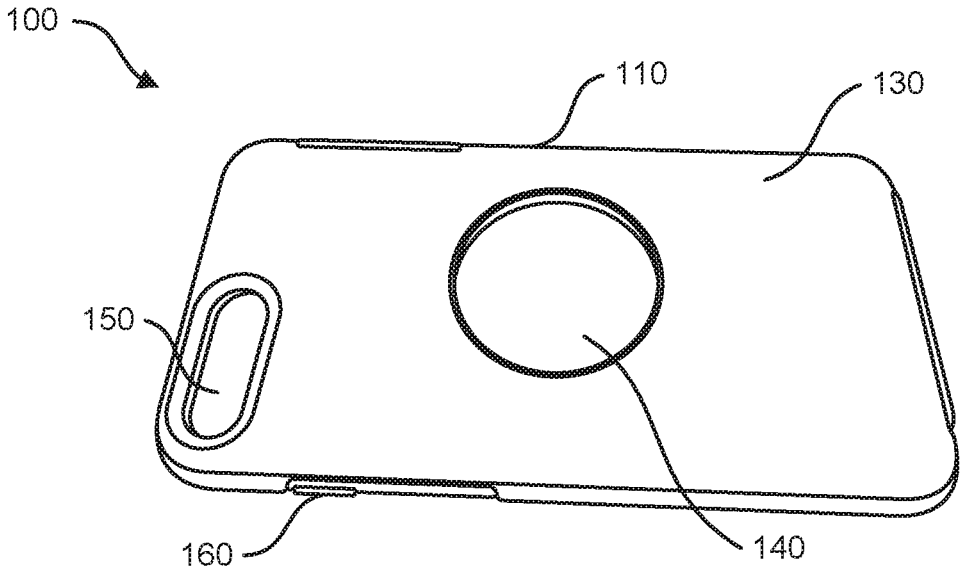
FIG. 3 illustrates a back view of the protective case of FIG. 2.

Protective case 100 also includes grip aperture 140 in the back surface of protective case 100. Grip aperture 140 extends from inside of protective case 100 through inner surface 120 and body 110 to provide an aperture or hole that extends all the way through to the back of the case. As discussed with respect to other figures herein, grip aperture 140 facilitates operation and use of a device grip, such as device grip 190, with a protective case, such as protective case 100. The size, shape, quantity, or position, of grip aperture 140 may vary. FIG. 3 illustrates a back view of protective case 100. Outer surface 130 of protective case 100 is visible in FIG. 3.

Figure 4:
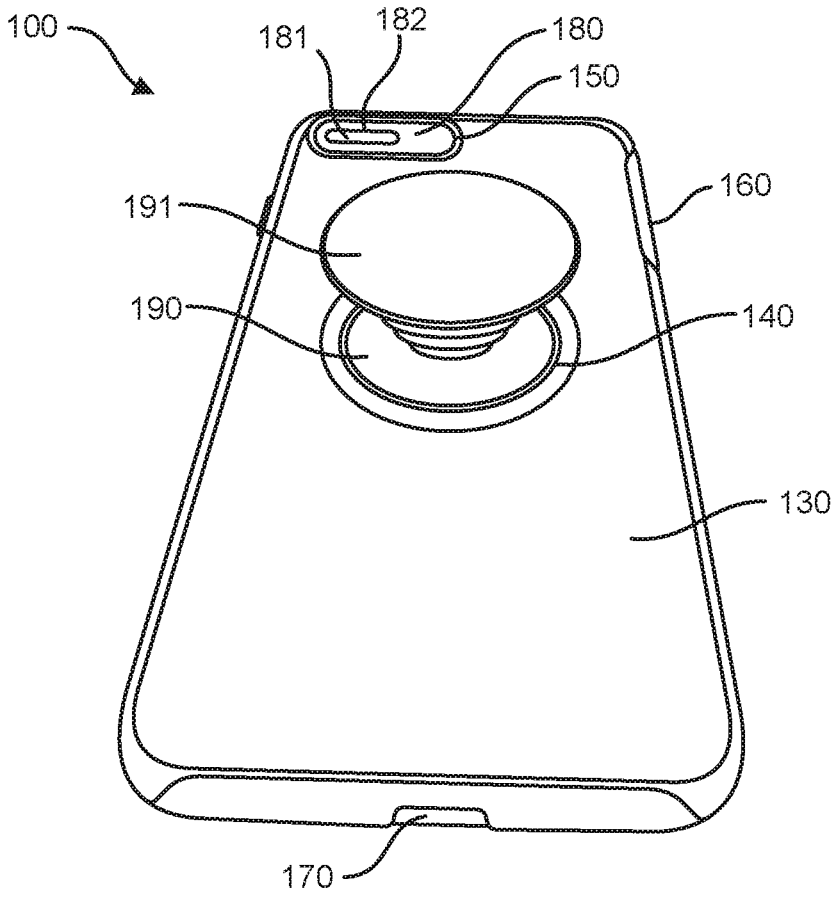
FIG. 4 illustrates a back perspective view of the protective case of FIG. 2 with the device grip of FIG. 1.

FIG. 4 illustrates a back perspective view of protective case 100 with device grip 190 installed. Although mostly hidden in FIG. 4, an electronic device 180 is installed in protective case 100 in FIG. 4 and can be partially seen through camera aperture 150. Electronic device 180 may be any type of phone, smartphone, tablet computer, gaming device, portable electronic device, audio player, video player, camera, portable computer, two-way radio, GPS receiver, and/or other portable device. Camera aperture 150 provides optical access for at least a camera lens 181 and/or a flash 182 of electronic device 180. Many other camera, flash, and lens configurations are possible.

As illustrated in FIG. 4, device grip 190 attaches directly to a back surface of electronic device 180 through grip aperture 140. Beneficially, protective case 100 does not interfere with the attachment of device grip 190 to electronic device 180. Device grip 190 can be attached to electronic device 180 in the same manner and position as it would be if protective case 100 was not present. In FIG. 4, device grip 190 is illustrated in an extended, partially extended, or use position.

FIG. 4 also illustrates an access port 170 for accessing an electrical interface of installed electronic device 180 (electrical interface not visible). The electrical interface may be for transmitting and/or receiving electrical data communication signals and/or power to/from electronic device 180. The electrical interface may include or may be configured to mate with a standardized electrical plug or connector such as, for example, a USB connector, a mini USB connector, a micro USB connector, an APPLE LIGHTNING® connector, a proprietary electronic connector, and/or an electrical connector of another type.

Protective case 100 may also permit access to other features of installed electronic device 180. For example, protective case 100 may permit access to an audio feature of electronic device 180, such as a speaker or headphone jack of electronic device 180. In some configurations, protective case 100 may include an aperture with a water impermeable membrane that allows sound to pass through the membrane while keeping water from passing through the associated aperture.

Figure 5:
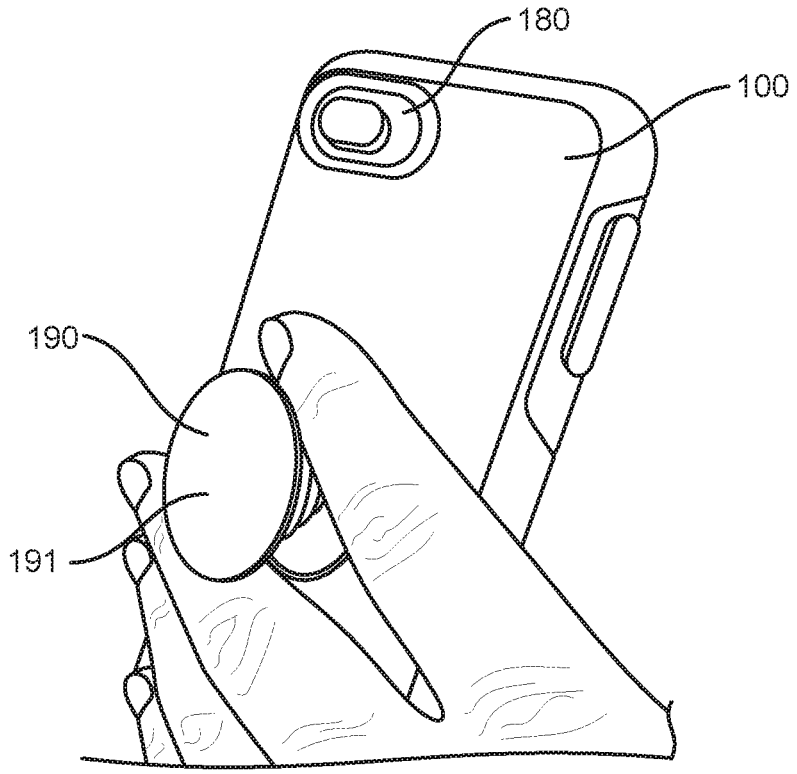
FIG. 5 illustrates a back perspective view of the protective case and device grip of FIG. 4 in use by a user.

FIG. 5 illustrates a back perspective view of protective case 100 and device grip 190 in use by a user. Similar to FIG. 4, device grip 190 is in an extended position, or partially extended position, that enables the user to more reliably, more easily, and/or more steadily hold protective case 100 and installed electronic device 180. The user places one or two fingers around or under grip end 191 of device grip 190 in order to hold electronic device 180. Since expanding portion 192 of device grip 190 has a smaller diameter or smaller cross section than grip end 191, it is easier for the user to hold installed electronic device 180 and the chances of dropping it are reduced.

Figure 6:
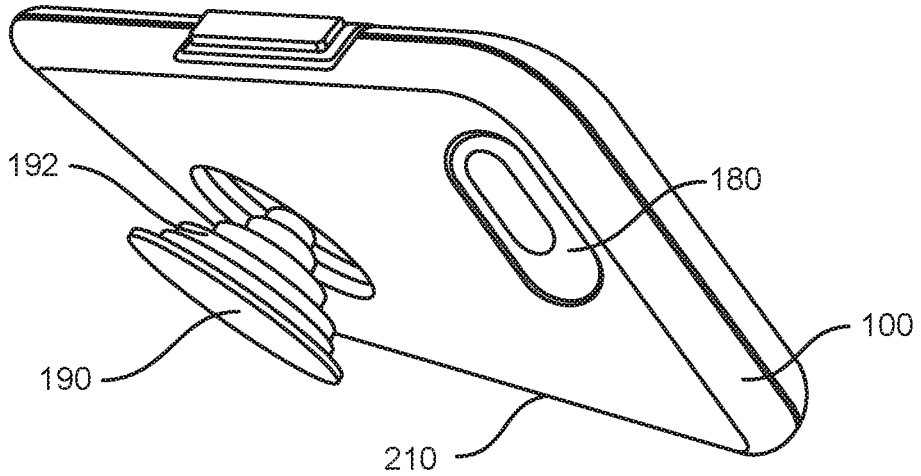
FIG. 6 illustrates a back perspective view of the protective case and device grip of FIG. 4 in a viewing configuration on a surface.

FIG. 6 illustrates a back perspective view of protective case 100 and device grip 190 in a viewing configuration on a surface 210. Surface 210 may be a desk, table, or tray on which a user wishes to position in order to view it without having to hold it. In some situations, expanding portion 192 of device grip 190 may pivot, flex, or snap in multiple directions to adjusting the resulting viewing angle of installed electronic device 180. Beneficially, protective case 100 permits this use and operation of device grip 190 and electronic device 180 to occur in a same or similar manner as it would if protective case 100 were not present.

Figure 7:
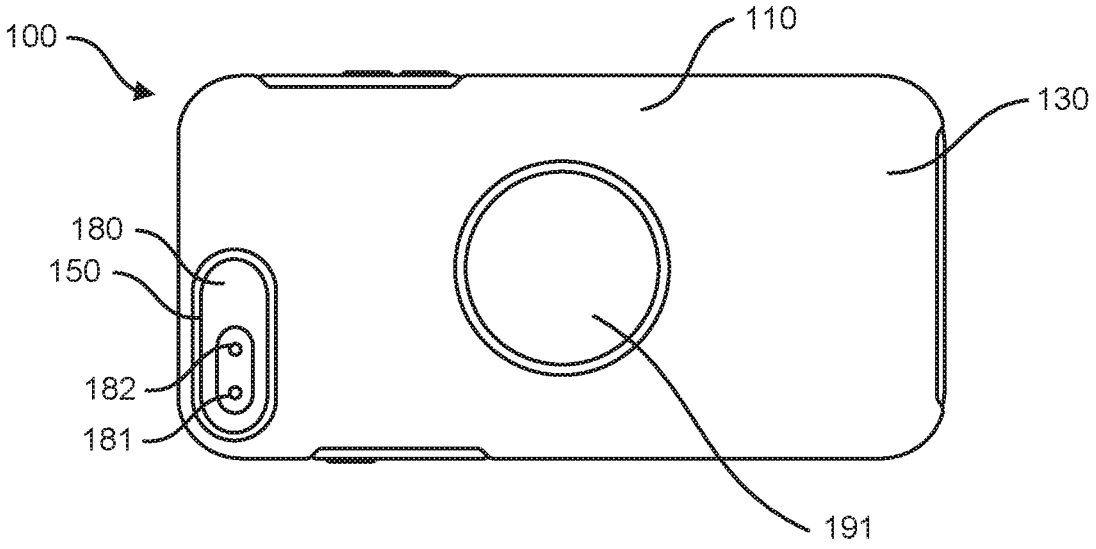
FIG. 7 illustrates a back perspective view of the protective case of FIG. 2 with the device grip of FIG. 1.
Figure 8:
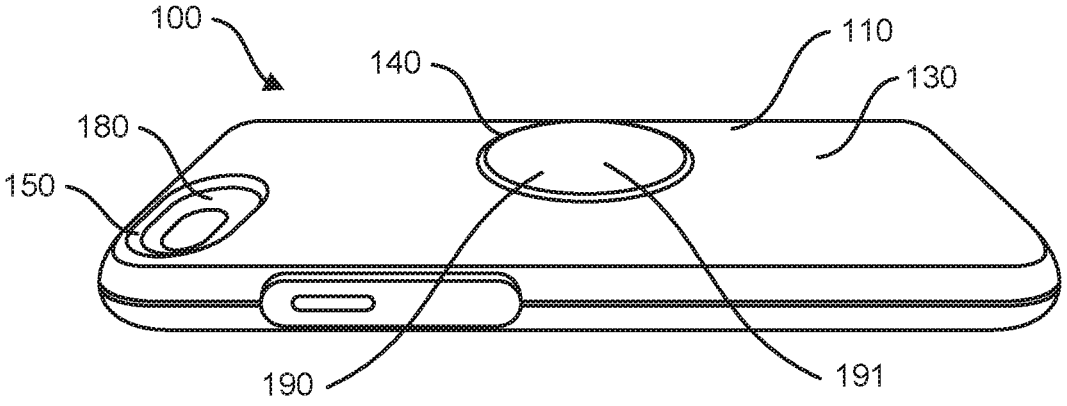
FIG. 8 illustrates a side view of the protective case of FIG. 2 with the device grip of FIG. 1.

FIG. 7 illustrates a back view of protective case 100 with electronic device 180 and device grip 190 in a non-extended position. This non-extended position may also be referred to as a stowed position, a storage position, a stored position, or a non-use position. FIG. 8 provides a side view of the configuration of FIG. 7. As illustrated in FIG. 8, back surface 130 of protective case 100 has a shape or contour that makes back surface 130 flush, substantially flush, or significantly flush with grip end 191 of device grip 190 when it is in the non-extended position. Because device grip 190 can be compressed to only a certain minimum height, without the improvements disclosed herein device grip 190 would extend past back surface 130 even in the stowed position. The resulting lip or edge of grip end 191 could make it difficult to slide the assembly in and out of pockets or bags and could result in unwanted snagging or catching. Further, a significant gap between an edge of grip end 191 and grip aperture 140 could be a path for dust, water, snow, mud, or debris to get inside protective case 100.

The contour or shape of back surface 130 extends up to meet the edge of grip end 191 at grip aperture 140 in order to provide a smoother back surface for the overall assembly even though protective case may have an overall or envelope thickness that is greater than it may otherwise have. The generally smoother overall envelope reduces or minimizes snagging or catching on pockets, bags, or other items when device grip 190 is in the non-extended position. This configuration may also provide a better overall aesthetic appearance. In this way, protective case 100 accommodates existing device grips, such as device grip 190, which may have a minimum thickness that is greater than a minimum back wall thickness of protective case 100. It should be noted that many shapes or contours of back surface 130 are possible as long as a smooth, somewhat smooth, flush, or somewhat flush interface is created between back surface 130 and grip end 191 at an edge of grip aperture 140.

In some examples, a thickness of the back wall of protective case 100 proximate grip aperture 140 is greater than thicknesses of other portions of the back wall such that outer surface 130 is approximately flush with grip end 191 when the device grip 190 is attached to the installed electronic device and is in a non-extended position. In some examples, outer surface 130 of the back wall of body 110 is non-planar such that outer surface 130 is approximately or substantially flush with grip end 191 when device grip 190 is attached to the installed electronic device and is in a non-extended position. In some examples, outer surface 130 of the back wall of body 110 of protective case 100 has a non-planar shape and is configured such that an outer edge of grip aperture 140 is proximate a distal end of the device grip 190 when device grip 190 is attached to the installed electronic device at a proximal end and is in a storage position.

In some examples, protective case 100 may be removable from electronic device 180 without removing device grip 190. This may be beneficial if an adhesive used to attach device grip 190 to electronic device 180 is permanent or semi-permanent.

It should be understood that many variations are possible to accommodate different types of device grips. Variations may include varying: a position of grip aperture 140, a shape of grip aperture 140, a size of grip aperture 140, a quantity of grip apertures, the thickness of the back wall of protective case 100, and/or one or more contours of back surface 130. The contour(s) may result in solid, hollow, or partially hollow portions of the back wall.

In some examples, a position of grip aperture 140 may be chosen based on known weight distribution characteristics of electronic device 180 and/or protective case 100 to achieve desired balance characteristics. In other examples, a position of grip aperture 140 may be chosen to improve or optimize use of an associated grip as a stand.

In some examples, back surface 130 may include colors or graphics which match or contrast with colors of graphics on grip end 191. In some cases, a non-round grip aperture may be used to better facilitate alignment or orientation of graphics.

Although protective case 100 is intended to work with already existing device grip designs, in some situations different lengths of device grips may be produced or offered to take into account or accommodate a thickness of protective case 100 such that the usable thickness of the extended device grip (see FIG. 5) is the same or similar as it would be in a standard installation in which no protective case was present.

In some examples, one or more contours of back may be chosen to better fit an inside of a user's hand or partially bent fingers in addition to accomplishing the other objectives disclosed herein. In other words, the back surface of protective case 100 may be curved to better fit a user's hand as well as provide a flush fit, or near flush fit, for a stowed device grip.

In some examples, each of grip aperture 140 and/or device grip 190 may include a gasket and/or gasket seat to form a dust-resistant, dustproof, water-resistant, waterproof, mud-resistant, mudproof, snow-resistant, and/or snowproof seal when device grip 190 is in the non-extended or stowed position. One or more of these features may be used in conjunction with an otherwise water-resistant or waterproof protective case 100.

In some examples, one or more areas of the edge of grip aperture 140 and/or grip end 191 may contain a small recess, cutout, gap, or notch which enables a user to get a fingernail or thin object between them to more easily extend it while providing minimal reduction of benefit to overall smooth, non-catching contour of the solution. The recess may be formed in grip aperture 140 and/or grip end 191. This recess may be in one particular area or in multiple distinct locations around the perimeter (for example, in two, three, or four locations). In other examples, a recess which facilitates extending of device grip 190 may exist around the entire perimeter of grip aperture 140 and/or grip end 191. In some examples, this feature may be implemented through use of a beveled or rounded edge in a specific area or the entire perimeter of grip aperture 140 and/or grip end 191.

In some examples, protective case 100 may include a removable plug to plug, close, or cover grip aperture 140 if not used and/or when not in use. In some examples, this plug may be formed as a part of body 110 such that it stays in place if a user does not use this option.

Figure 9A:
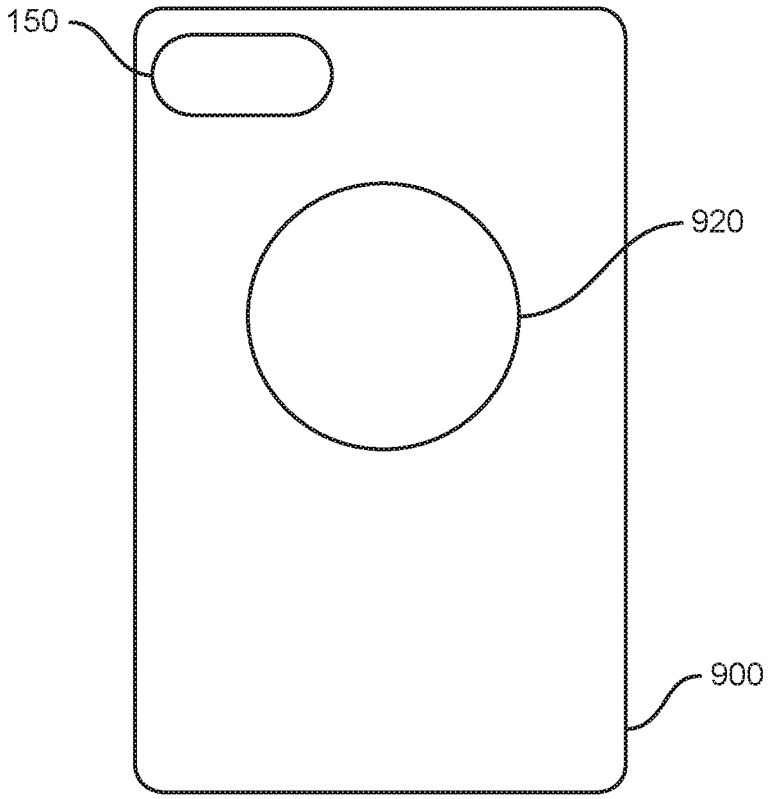
FIG. 9A illustrates a protective case and a device grip cap.

FIG. 9A illustrates a protective case 900 and a device grip cap 920. Protective case 900 is a protective case or cover for an electronic device, such as a smartphone or tablet computer, and may have any of the features, functions, and/or characteristics of protective case 100. However, protective case 900 may not necessarily include grip aperture 140 and/or may not have a thicker region, sloped region, or contoured region which provides a smooth interface up to a top edge of an installed device grip. In the example of FIG. 9A, device grip cap 920 provides an alternative solution that also provides a generally, most, substantially, or primarily smooth outer surface when device grip 190 is not in use in order to reduce the chances of it catching or snagging on edges of a pocket, bag, or other item.

Figure 9B:
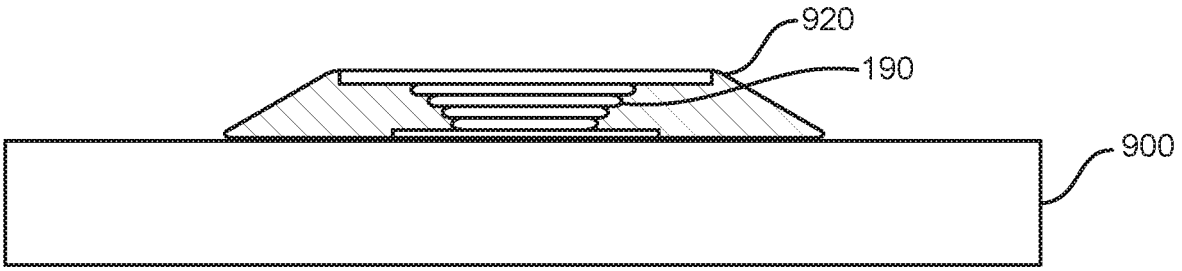
FIG. 9B illustrates a cross-sectional end view of the protective case and device grip cap of FIG. 9A.

FIG. 9B illustrates an end cross-sectional view of device grip cap 920 installed over a device grip 190 that is attached to protective case 900. In the example of FIG. 9B, device grip 190 is in the stowed or non-use position. Device grip 190 includes a tapered, accordion-like structure that allows it to be compressed or compacted when not in use. Device grip cap 920 fits over device grip 190 such that the back surface of the overall assembly is generally smooth, or at least smoother than it would be were device grip cap 920 not present. In this way, inadvertent snagging or catching of device grip 190 on another object is reduced when device grip 190 is in the stowed position. This configuration makes the overall assembly easier to slide in and out of pockets, bags, and/or similar storage areas.

Device grip cap 920 may be made of any material or combination of materials and may be attached to device grip 190 using any known method. In some examples, device grip cap 920 may have one or more transparent regions which allow a logo or graphics on a top of device grip 190 to remain visible even though device grip cap 920 is installed over it. Device grip cap 920 may have a shape, contours, and/or features that are different than those illustrated in FIGS. 9A-9D while still using the same techniques and/or achieving similar results.

Figure 9C:
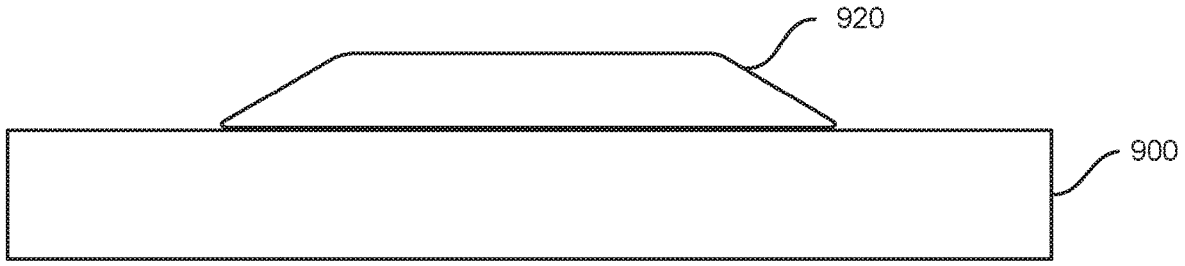
FIG. 9C illustrates an end view of the protective case and device grip cap of FIG. 9A.

When device grip 190 is in the unstowed or use position, device grip cap 920 is moved away from protective case 900 along with the top of device grip 190 to still allow device grip 190 to be used as intended and provide the benefits described herein. Beneficially, device grip cap 920 provides a smoother back surface for the assembly without necessarily having to utilize a contoured back surface on the protective case as illustrated in FIGS. 3-8. In other words, the benefit can be achieved without a specialized protective case having the features described in FIGS. 3-8. FIG. 9C illustrates an end view of protective case 900 and device grip cap 920 installed over device grip 190.

Figure 9D:
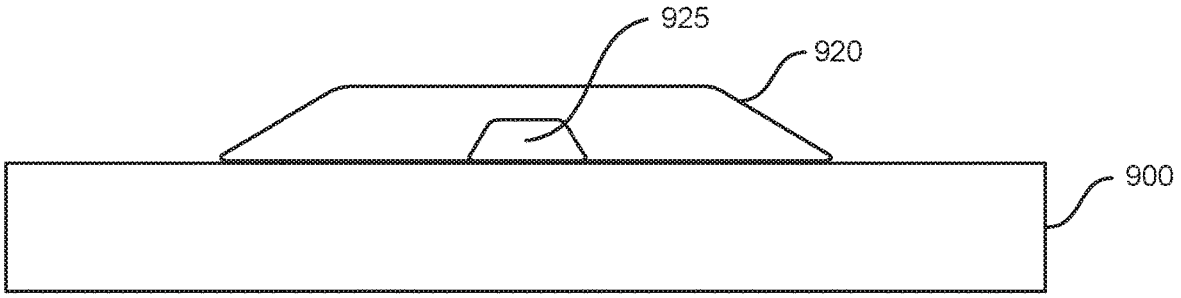
FIG. 9D illustrates the device grip cap of FIG. 9A with an opening feature.

FIG. 9D illustrates device grip cap 920 including an opening feature 925. Opening feature 925 may be any feature which makes it easier to get a finger-hold or grip on device grip cap 920 to pull it and device grip 190 to the unstowed position. Opening feature 925 may include a cutout, slot, hole, recess, ridge, protrusion, lip, and/or textured surface for getting a better grip on device grip cap 920 for deployment. Multiple instances of opening feature 925 may be distributed around the perimeter of device grip cap 920. Opening feature 925 may also be configured for use with a small tool in addition to, or in place of, operation using a finger.

Figure 10A:
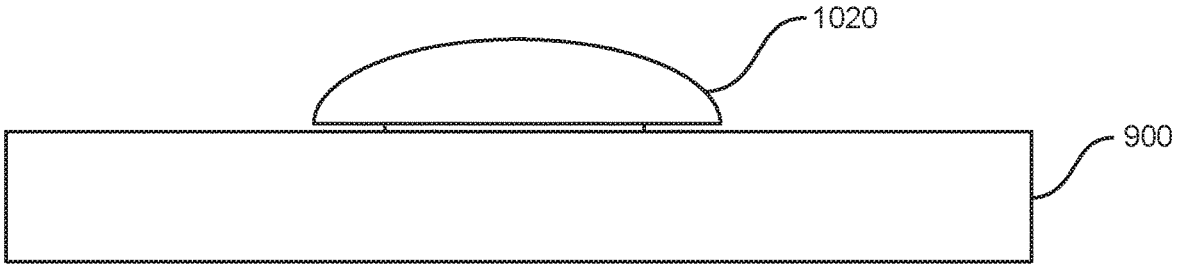
FIG. 10A illustrates a protective case and a bistable cap.
Figure 10B:
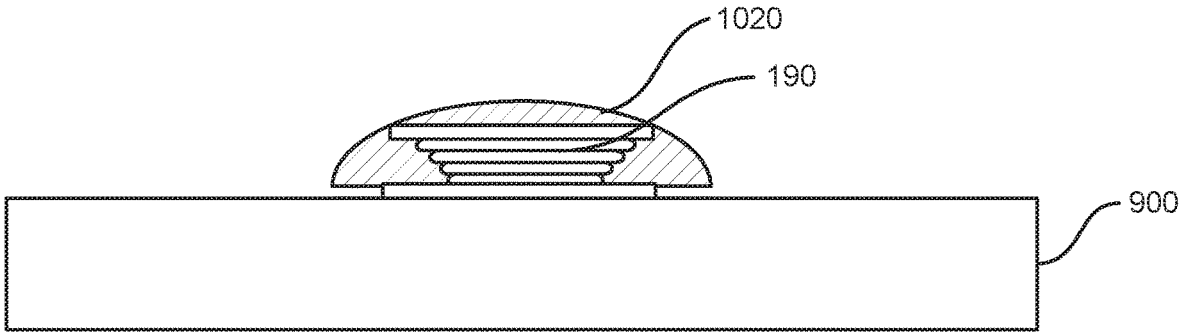
FIG. 10B illustrates a cross-sectional end view of the protective case and bistable cap of FIG. 10A.

FIG. 10A illustrates protective case 900 and a bistable cap 1020. Bistable cap 1020 provides an alternative solution for providing a generally smooth outer surface when device grip 190 is not in use in order to reduce the chances of it snagging on edges of a pocket, bag, or other item. FIG. 10B illustrates an end cross-sectional view of bistable cap 1020 installed over a device grip 190 that is attached to protective case 900. In the example of FIG. 10B, device grip 190 is in the stowed or non-use position. It includes a tapered, accordion-like structure that allows it to be compressed when not in use. Bistable cap 1020 fits over device grip 190 such that the back surface of the overall assembly is generally smooth, or at least smoother than it would be if bistable cap 1020 not present. In this way, inadvertent snagging or catching of device grip 190 is reduced when device grip 190 is in the stowed position.

Figure 10C:
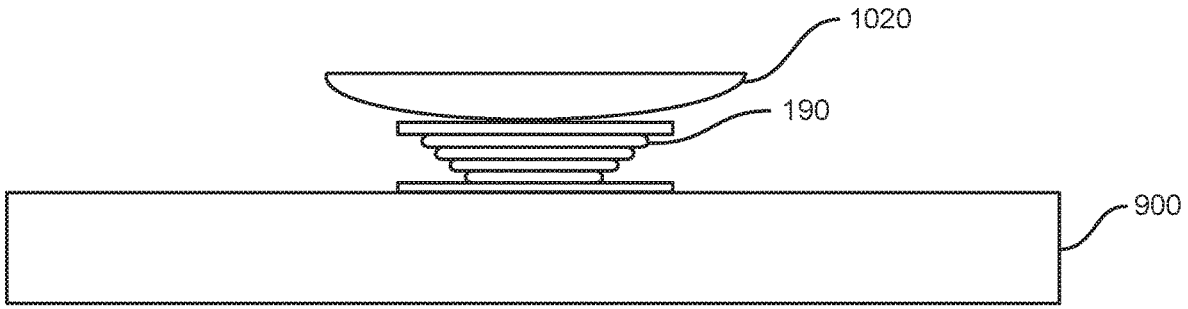
FIG. 10C illustrates an end view of the protective case and bistable cap of FIG. 10A.

Bistable cap 1020 may be made of any material or combination of materials and may be attached to device grip 190 using any known method. Bistable cap 1020 generally has two stable states or positions, which are illustrated in FIGS. 10A-10C. In one example, bistable cap 1020 has a shape similar to a portion of a sphere or dome with a concave side and convex side and can be reversibly reconfigured such that the concave and convex sides are alternated. In other words, it may be a portion of a dome or sphere that can be turned 'inside out.' In some examples, bistable cap 1020 may not necessarily be spherical. Bistable cap 1020 may have a shape, contours, and/or features that are different than those illustrated in FIGS. 10A-10C.

When a user wishes to use device grip 190, a center portion of bistable cap 1020 is pressed with a finger or other object in a generally downward direction. This externally applied force or pressure causes bistable cap to 1020 transition to the other of its two stable states, as illustrated in FIG. 10C. It temporarily remains in this state to allow a user to access and/or use device grip 190. When the user is finished, one or more edges of bistable cap 1020 are pressed to cause it to return to the initial state illustrated in FIG. 10A.

Device grip cap 920 and/or bistable cap 1020 may also be removable or replaceable and may include graphics, colors, pictures, and/or patterns that are selected to complement or coordinate with protective case 100.

While the examples of FIGS. 9A-9D and 10A-10C are illustrated with respect to a protective case 900, any of the elements or features may be implemented or used with a protective case. In other words, any of device grip 190, device grip cap 920, and/or bistable cap 1020 may be used directly with an electronic device even though no protective case is present. In these examples, device grip 190 may be attached directly to a back surface of the electronic device. In some cases, the term 'housing' may be used herein to refer to either the primary housing of an electronic device and/or a supplemental protective case or cover for an electronic device.

Figure 11:
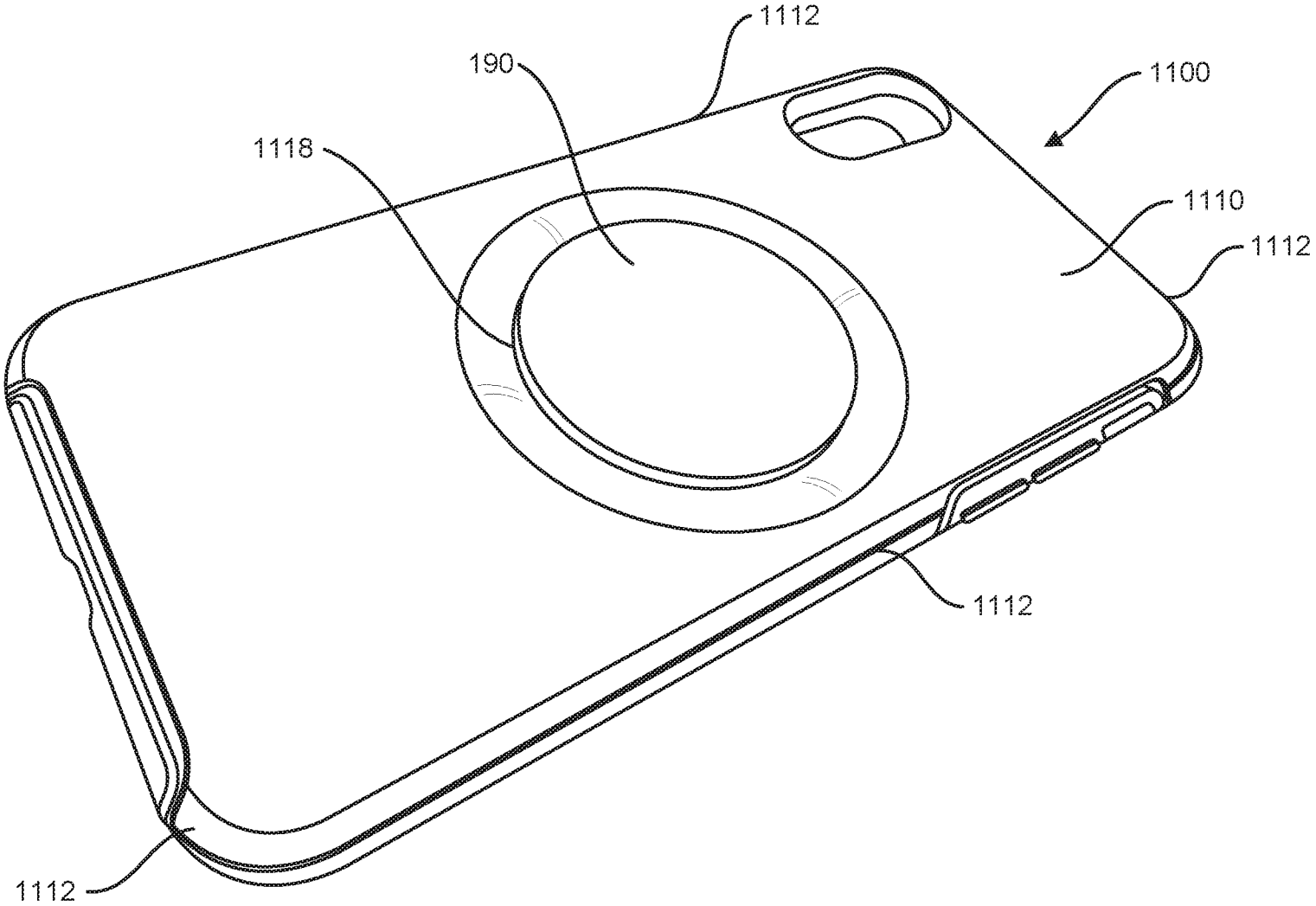
FIG. 11 illustrates a back view of a protective case with a device grip in a stowed position.

FIG. 11 illustrates a back view of a protective case 1100 with device grip 190 in a stowed position. Protective case 1100 may contain any of the features, functions, elements, and/or characteristics of previously described protective case 100 and/or protective case 900. In the illustration of FIG. 11, an electronic device is removably insertable into protective case 1100 from an opposite side of protective case 1100 (from the side facing into the page in FIG. 11). Sides 1112 of protective case 1100 hold the electronic device in protective case 1100 and may be flexible or pliable. Other protective case configurations are possible.

Back surface 1110 of protective case 1100 has a shape which includes contours selected to better accommodate grip 190. Specifically, back surface 1110 includes a concave area 1118 in which device grip 190 is attached to protective case 1100. Concave area 1118 may also be described as a recess, a recessed area, and/or a cavity. When device grip 190 is in a stowed or collapsed position, a significant portion, a majority of, or all of device grip 190 is positioned within concave area 1118. As with other examples discussed herein, this configuration provides a smoother overall surface or envelope of protective case 1100, including device grip 190. This design reduces the chances that device grip 190 will get snagged on an edge of a pocket or a bag when device grip 190 is not in use and is in the stowed position. In some examples, stowed device grip 190 may be completely flush with back surface 1110. In other examples, stowed device grip 190 may be partially or substantially flush with back surface 1110.

Back surface 1110 of protective case 1100 may include a shape or contours that slope upward from the sides 1112 of protective case 1100 to the edge of concave area 1118. An inner surface of protective case 1100 may include a similar corresponding shape or contour. The sloped back surface and contours provide the space necessary between back surface 1110 and a back surface of an installed electronic device to recess concave area 1118 between them. In some examples, a top edge of stowed device grip 190 may be fully within concave area 1118 and may be below a plane of the upper rim or edge of concave area 1118. In other words, when back surface 1110 of protective case 1100 is laid on a flat surface, stowed device grip 190 may be sufficiently recessed to not contact the flat surface. However, in other configurations, stowed device grip 190 may be flush with back surface 1110 or may extend slightly above the edges of concave area 1118 even when in the stowed position.

In addition, there may be a gap, opening, or slot between a top edge of stowed device grip 190 and the rim or edge of recessed area 1118. This gap or opening makes it easier to for a user to grasp an edge of stowed device grip 190 to pull it out to the extended position. This gap, opening, or slot may extend all the way around device grip 190 or may be limited to a portion of recessed area 1118 and/or device grip 190.

Figure 12:
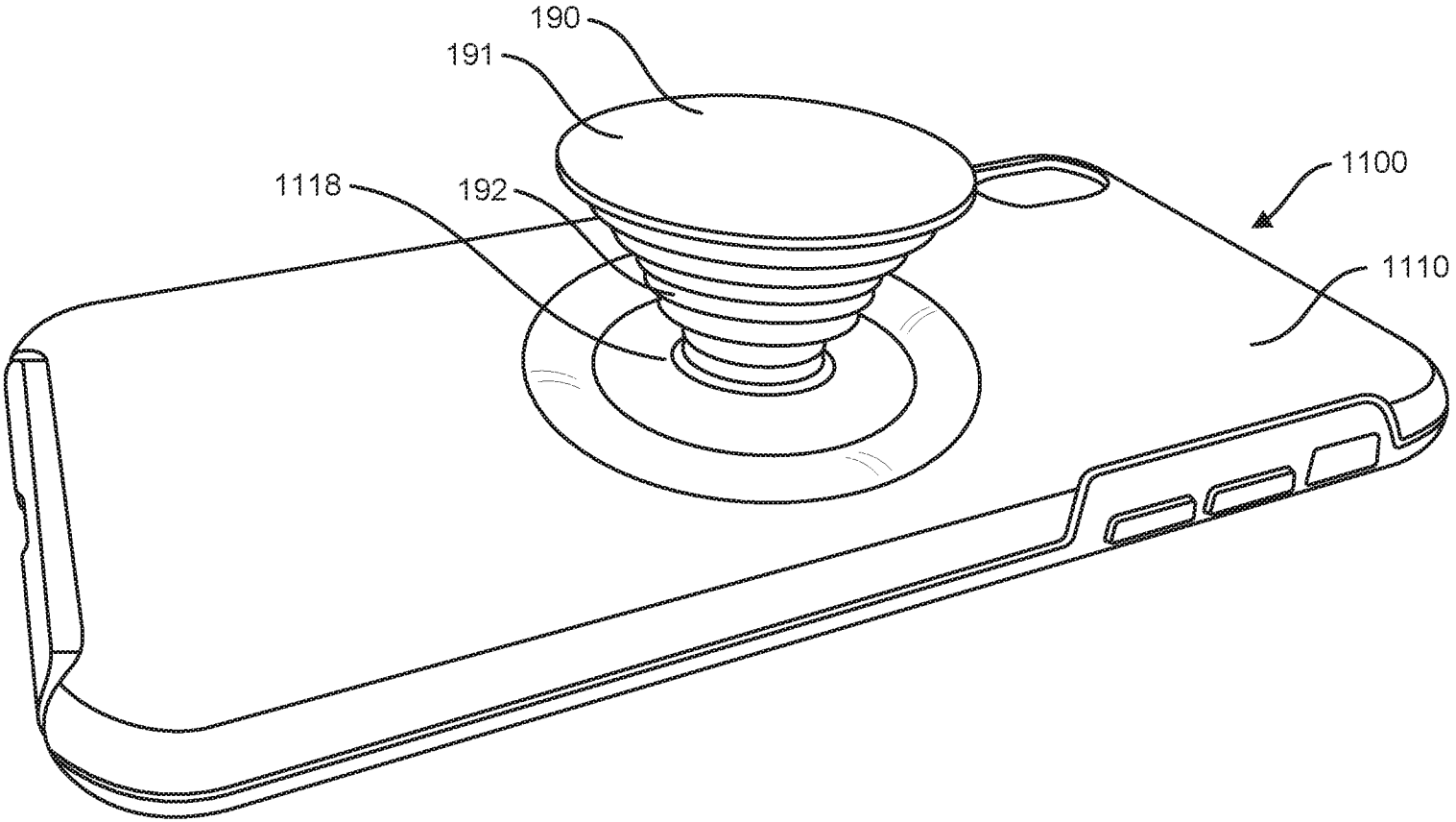
FIG. 12 illustrates the protective case of FIG. 11 with the device grip in a use position.

FIG. 12 illustrates protective case 1100 with device grip 190 is an extended or use position. This configuration may provide many advantages as discussed in the examples of FIGS. 4-6 and elsewhere herein. In this configuration, device grip 190 extends significantly beyond concave area 1118 so it can be used for holding or supporting protective case 1100 in various ways. Expanding portion 192 of device grip 190 is also visible in FIG. 12. While device grip 190 and concave area 1118 are round in these examples, other compatible shapes are possible including oval, square, rectangular, triangular, or any polygon.

Figure 13:
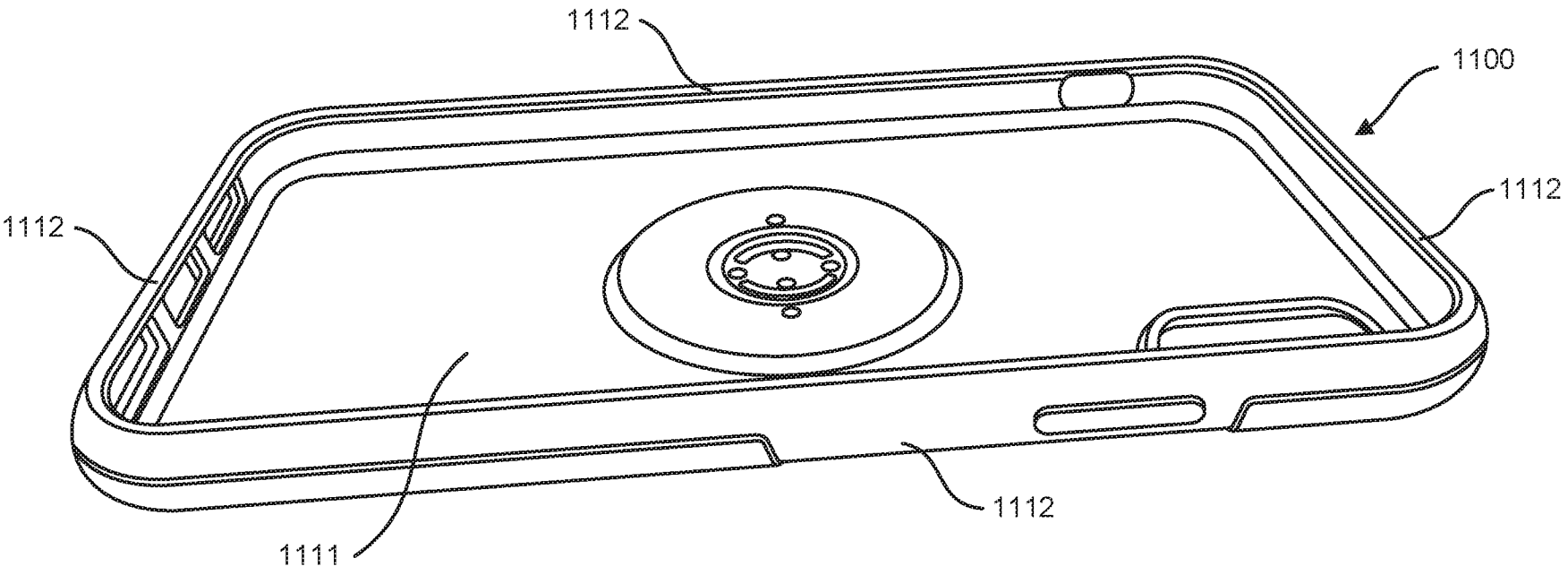
FIG. 13 illustrates a front perspective view of the protective case of FIG. 11.

FIG. 13 illustrates a front perspective view of protective case 1100 which illustrates inside surface 1111 of protective case 1100. An opposing or back side of concave area 1118 is also visible on inside surface 1111. However, this internal structure or shape is not necessary and inside surface may be flat or planar. In the latter case, the back wall of protective case 100 may vary in thickness to provide the desired contour and/or a cavity may exist between inside surface 1111 and outside surface 1110.

Figure 14:
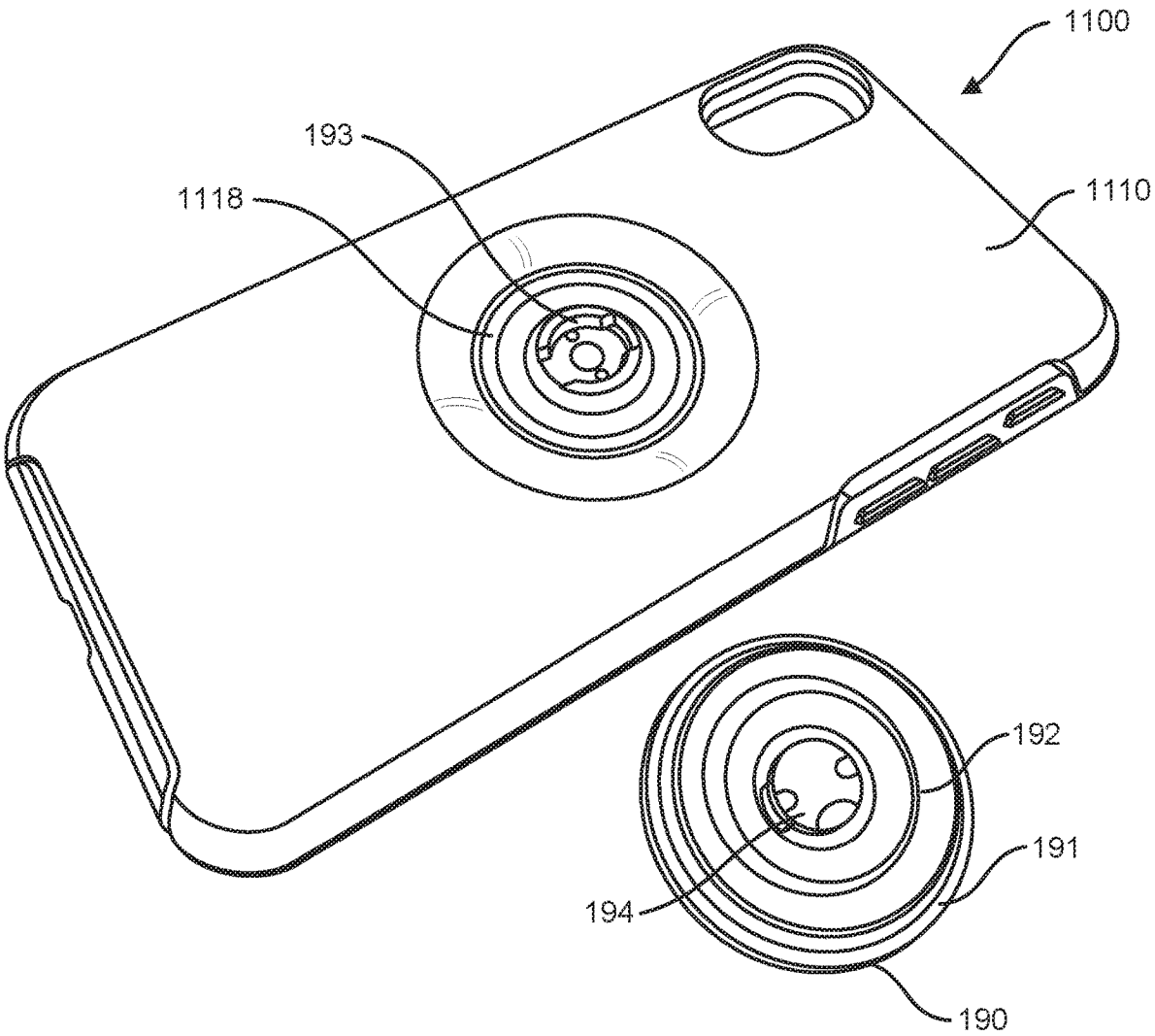
FIG. 14 illustrates the protective case of FIG. 11 with the device grip detached.

FIG. 14 illustrates protective case 1100 with device grip 190 detached. Device grip 190 is illustrated with expanding portion 192 in a collapsed position. In FIG. 14, a receiver 193 is visible on back surface 1110 in concave area 1118. Receiver 193 may be any type of mechanical structure or feature configured to removably engage with and/or removably attach to an attachment feature 194 of device grip 190. Receiver 193 and attachment feature 194 may include any features or elements which allow them to temporarily engage, connect, attach, or interface, but also be selectively disengaged, disconnected, and/or detached. Receiver 193 may be molded as part of protective case 1100 or may be a separate element that is adhered to or affixed to protective case 1100. In other examples, receiver 193 may be a separate component that becomes affixed to protective case 1100 as part of a molding process of protective case 1100. Other configurations are possible.

The configuration in FIG. 14 provides several distinct advantages. First, device grip 190 may be used with an electronic device without have to adhere it directly to the electronic device. Second, device grip 190 may be collapsed or stowed partially or completely into concave area 1118 when not in use thereby reducing unwanted catching or snagging on other objects. Third, device grip 190 is readily removable from the protective case. It may be desirable to remove the device grip for a number of reasons including: because it is not expected to be used in the near future, in order to switch to a different device grip having different colors, graphics, or features, and/or to replace a broken device grip.

Attachment feature 194 of device grip 190 may attached to receiver 193 in a variety of ways. In one example, the two elements may utilize rotary engage features that attach or detach by rotating the two elements with respect to each other. One or both components may also include retention features which cause them engage in a manner in which they click or snap into place and require additional force for removal. Device grip 190 may be configured such that the top 191 only engages attachment feature 194 to rotatably remove when device grip 190 is in the collapsed position and/or when a downward force is applied. In this way, device grip 190 may only be removable when it is in the collapsed position and may reduce the chances of unintended detachment.

Figure 15:
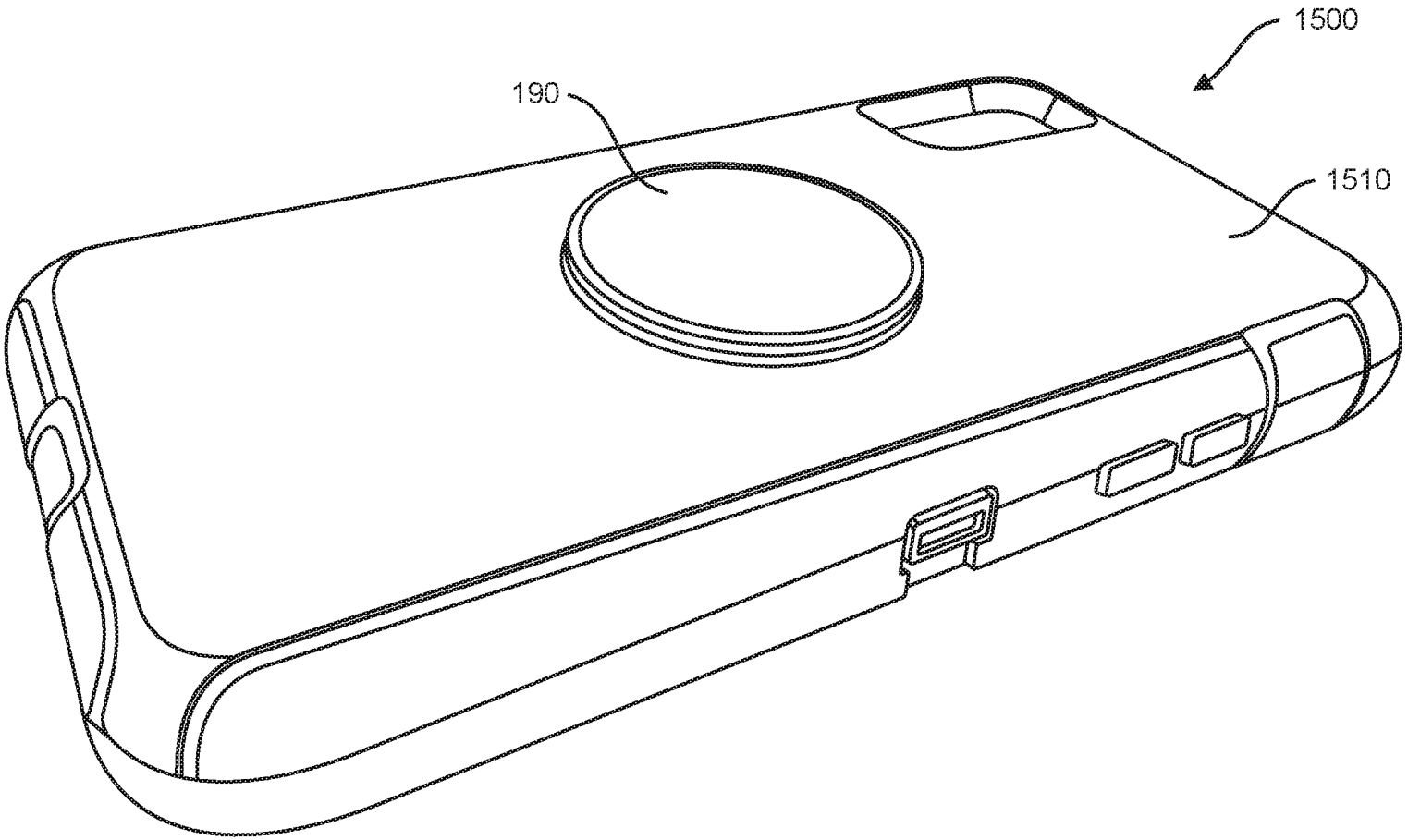
FIG. 15 a back view of a protective case with a device grip in a stowed position.

FIG. 15 illustrates a back view of a protective case 1500 with device grip 190 in a stowed position. Protective case 1500 may contain any of the features, functions, elements, and/or characteristics of previously described protective case 100, protective case 900, and/or protective case 1100. In the illustration of FIG. 15, an electronic device is removably insertable into protective case 1500 from an opposite side of protective case 1500 (from the side facing into the page in FIG. 15).

Figure 16:
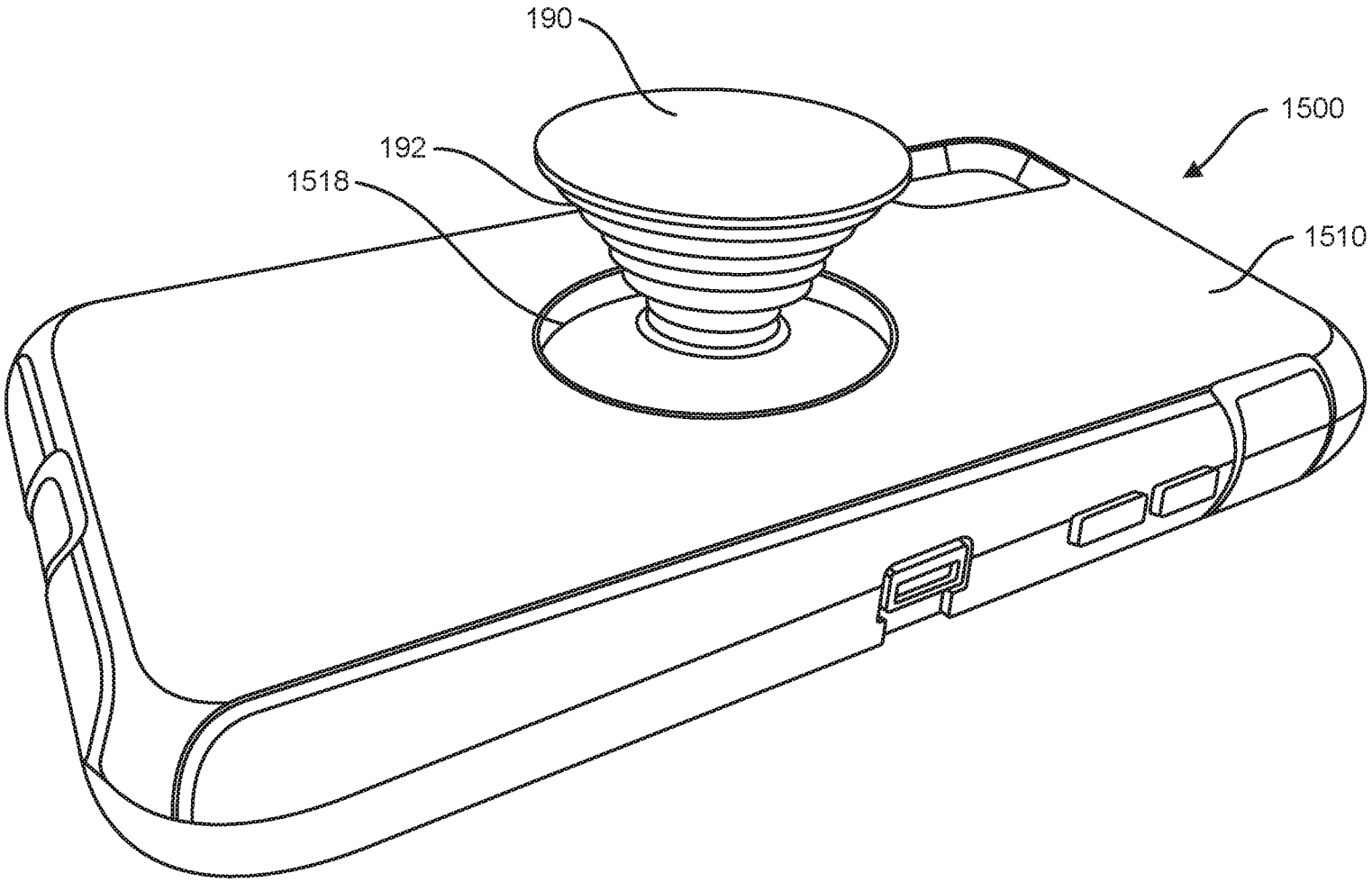
FIG. 16 illustrates the protective case of FIG. 15 with the device grip in a use position.

FIG. 16 illustrates protective case 1500 with device grip 190 in an extended or use position. This configuration may provide advantages similar to those discussed with respect to the examples of FIGS. 4-6 and elsewhere herein. In this configuration, device grip 190 extends so it can be used for holding or supporting protective case 1500 in various ways. Expanding portion 192 of grip 190 is also visible in FIG. 16. FIG. 16 illustrates that back surface 1510 of protective case 1500 includes a cutout or recess 1518 that corresponds a size and shape of device grip 190. Recess 1518 allows at least a portion of device grip 190 to be recessed with respect to back surface 1510 such that device grip 190 protrudes less than it otherwise would when it is in the stowed position.

Figure 17:
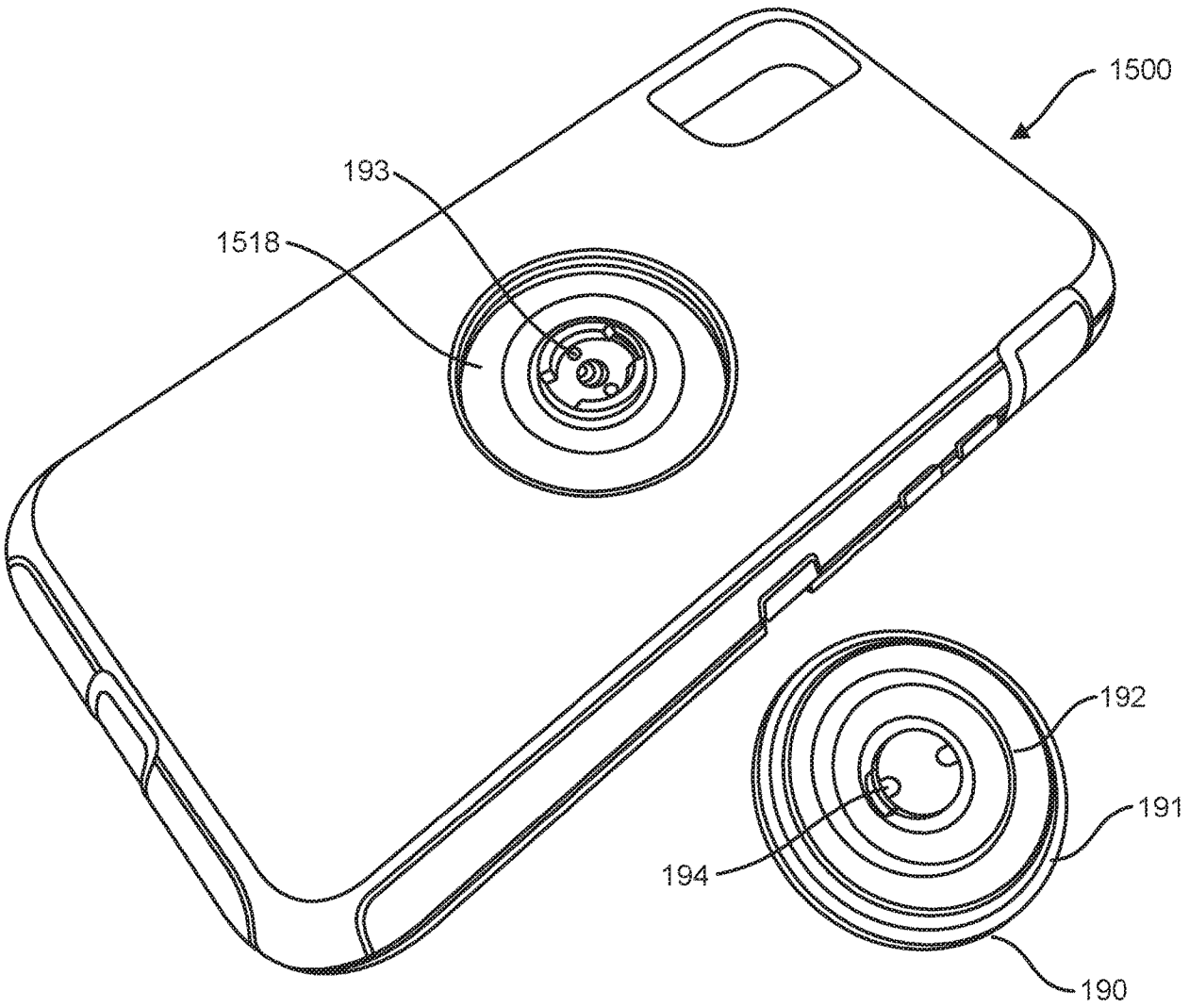
FIG. 17 illustrates the protective case of FIG. 15 with the device grip detached.

FIG. 17 illustrates protective case 1500 with device grip 190 detached. Device grip 190 is illustrated with expanding portion 192 in a collapsed position. In FIG. 17, a receiver 193 is visible on back surface 1510 in recessed area 1518. Receiver 193 may be molded as part of protective case 1500 or may be a separate element that is adhered to or affixed to protective case 1500. In other examples, receiver 193 may be a separate component that becomes affixed to protective case 1500 as part of the molding process of protective case 1500.

The configuration illustrated in FIG. 17 provides several distinct advantages. First, device grip 190 may be used with an electronic device without have to adhere it directly to the electronic device. Second, device grip 190 may be collapsed or stowed partially into recessed area 1518 when not in use to reduce unwanted catching of it on other objects, such as the edge of a person's pocket. Third, device grip 190 is readily removable from the protective case. It may be desirable to remove the device grip for a number of reasons including: because it is not expected to be used in the near future, in order to switch to a different device grip, and/or to replace a broken device grip. In some examples, a user may wish to switch between device grips having different colors or graphics.

Figure 18:
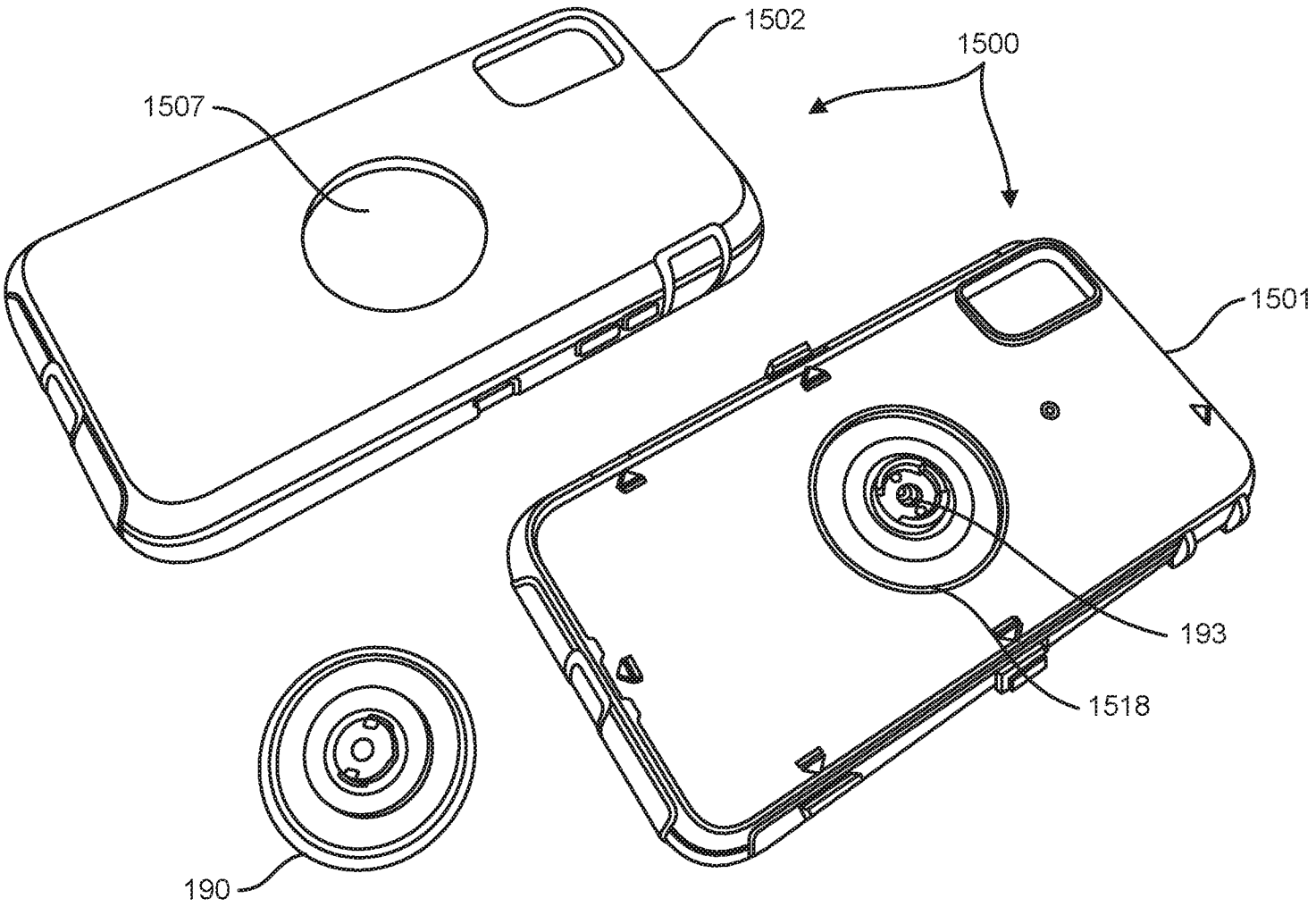
FIG. 18 illustrates the configuration of FIG. 17 with the protective case further disassembled.

FIG. 18 illustrates the configuration of FIG. 17 with protective case 1500 further disassembled. Protective case 1500 includes an inner shell 1501 and an outer layer 1502 that fits over inner shell 1501. In some examples, outer layer 1502 may be a pliable cushion layer. Inner shell 1501 includes receiver 193 and recessed area 1518. Outer layer 1502 includes an opening or aperture 1507 that coincides with recessed area 1518 and device grip 190 when attached. This configuration allows device grip 190 to be at least partially recessed into protective case 1500 in in order to reduce the amount it protrudes when in the stowed position while still leaving enough of it accessible so a user can grasp it with a fingertip or fingernail.

Various components described herein may be manufactured, provided, or sold in the form of a system or a kit. The system or kit may include any combination of: a protective case or cover having any combination of the features described herein and a compatible device grip. The system or kit need not include every component or feature described herein.

The elements, components, and steps described herein are meant to exemplify some types of possibilities. In no way should the aforementioned examples limit the scope of the invention, as they are only exemplary embodiments.

The phrases "in some embodiments," "according to some embodiments," "in the embodiments shown," "in other embodiments," "in some examples," "in other examples," "in some cases," "in some situations," "in one configuration," "in another configuration," and the like generally mean that the particular technique, feature, structure, or characteristic following the phrase is included in at least one embodiment of the present invention and/or may be included in more than one embodiment of the present invention. In addition, such phrases do not necessarily refer to the same embodiments or to different embodiments.

The foregoing disclosure has been presented for purposes of illustration and description. Other modifications and variations may be possible in view of the above teachings. The embodiments described in the foregoing disclosure were chosen to explain the principles of the concept and its practical application to enable others skilled in the art to best utilize the invention. It is intended that the claims be construed to include other alternative embodiments of the invention except as limited by the prior art.

What is claimed is:

1. A protective case system for use with an electronic device, the protective case system comprising:

an extendable device grip having an attachment mechanism, the extendable device grip having a stowed configuration and an extended configuration, wherein the extendable device grip is configured to be transitioned between the stowed configuration and the extended configuration by a user;

a bistable cap attached to an end of the extendable device grip opposite the attachment mechanism, wherein the bistable cap has a first state and a second state; and a protective case comprising:

an inner shell configured for receiving and removably retaining the electronic device, the inner shell having at least a back wall and side walls, the back and side walls of the inner shell configured to cover at least a portion of the electronic device and removably retain the electronic device when the electronic device is installed in the inner shell;

a receiver to which the attachment mechanism of the extendable device grip is removably attachable for removably attaching the extendable device grip to the protective case, wherein the receiver is positioned on an outer surface of the back wall of the inner shell;

wherein the bistable cap covers the extendable device grip when the extendable device grip is attached to the receiver in the stowed configuration and the bistable cap is in the first state.

2. The protective case system of claim 1 wherein the attachment mechanism of the extendable device grip is rotatably attachable to the receiver of the inner shell.

3. The protective case system of claim 1 wherein the extendable device grip includes a collapsible tapered accordion structure configured to enable the extendable device grip to transition between the extended configuration and the stowed configuration, and wherein the tapered accordion structure is sized to fit between fingers of a user.

4. The protective case system of claim 1 wherein one or both of the receiver and the attachment mechanism include a snap retention feature configured for retaining the extendable device grip to the inner shell.

5. The protective case system of claim 1 wherein the bistable cap is dome shaped and curves away from the extendable device when in the second state.

6. The protective case system of claim 1 wherein the extendable device grip is configured to be removable from the receiver of the inner shell without removing the outer cushion layer from the inner shell.

7. The protective case system of claim 1 wherein the outer cushion layer is configured to be removable from the inner shell over the attached extendable device grip without removing the extendable device grip from the inner shell.

8. The protective case system of claim 1 wherein a gap is present between an edge of the aperture of the outer cushion layer and a top edge of the extendable device grip when the extendable device grip is attached to the inner shell and is in the stowed configuration.

9. A protective case for use with an electronic device, the protective case comprising:

an extendable device grip having an attachment mechanism, the extendable device grip having a stowed configuration and an extended configuration, the extendable device grip having a bistable cap attached to an end of the extendable device grip opposite the attachment mechanism, wherein the bistable cap has first and second stable states;

the protective case comprising:

an inner shell adapted for receiving and removably retaining the electronic device, the inner shell having at least a back wall and side walls, the back and side walls of the inner shell adapted to cover at least a portion of the electronic device and removably retain the electronic device when the electronic device is removably installed in the inner shell;

a receiver to which the extendable device grip is rotatably attachable for removably attaching the extendable device grip to the inner shell, wherein the receiver is positioned on an outer surface of the back wall of the inner shell.

10. The protective case of claim 9 wherein the bistable cap has a convex shape when in the first stable state and a concave shape when in the second stable state.

11. The protective case of claim 9 wherein the receiver is permanently affixed to the back wall of inner shell.

12. The protective case of claim 9 wherein the receiver is molded into the back wall of the inner shell.

13. The protective case of claim 9 wherein the receiver includes a snap retention feature having an interference fit with the attachment mechanism of the extendable device grip for removably retaining the extendable device grip to the receiver.

14. The protective case of claim 9 further comprising an inner cushioning liner affixed to an interior surface of the inner shell and adapted for directly cushioning the installed electronic device.

15. A protective case system for use with an electronic device, the protective case system comprising:

an extendable device grip for assisting a user in holding the electronic device when the electronic device is installed in the protective case, the extendable device grip having a cap with two stable states;

a body configured for receiving and removably retaining the electronic device, the body having at least a back wall and side walls, the back and side walls configured to cover at least a portion of the electronic device when the electronic device is installed in the protective case, the back wall of the body having an aperture that extends through the back wall;

an outer cushion layer configured to be removably disposable over at least a portion of the back and side walls of the body of the protective case;

an inner cushion layer affixed to an inside surface of the body and configured to directly contact and cushion the installed electronic device; and a grip aperture extending through a back wall of the outer cushion layer, the grip aperture having a size and a shape adapted configured to permit direct attachment of the extendable device grip to a back surface of the installed electronic device through the grip aperture of the outer cushion layer and through the aperture of the back wall of the body, wherein the outer cushion layer and the body are configured to be removable from the electronic device without having to remove the extendable device grip from the electronic device.

16. The protective case system of claim 15 wherein an edge of the cap includes a recess configured for receiving a fingernail for facilitating transition of the cap from one of the two stable states to the other of the two stable states.

17. The protective case system of claim 15 wherein the body includes a first member and a second member, wherein the first member is removably attachable to the second member to at least partially enclose the installed electronic device.

18. The protective case system of claim 15 wherein the extendable device grip is configured to be removably attachable to the electronic device.

19. The protective case system of claim 15 wherein the shape of the grip aperture further extends through the inner cushion layer.

20. The protective case system of claim 15 wherein each of the body and the outer cushion layer having corresponding camera apertures configured for providing optical access for a camera of the installed electronic device.

* * * * *